United States Patent [19]

Pittet et al.

[11] 4,000,090

[45] Dec. 28, 1976

[54] ENOL ESTERS OF AN ALPHA SUBSTITUTED ACETALDEHYDE FRAGRANCE COMPOSITIONS

[75] Inventors: Alan Owen Pittet, Atlantic Highlands; Erich Manfred Klaiber, Neptune; Manfred Hugo Vock, Locust, all of N.J.; Edward J. Shuster, Brooklyn, N.Y.; Joaquin Vinals, Red Bank, N.J.

[73] Assignee: International Flavors & Fragrances Inc., New York, N.Y.

[22] Filed: Oct. 7, 1975

[21] Appl. No.: 620,355

Related U.S. Application Data

[63] Continuation-in-part of Ser. No. 507,412, Sept. 19, 1974, Pat. No. 3,940,499.

[52] U.S. Cl. ..... 252/522; 260/598

[51] Int. Cl.[2] ..... C11B 9/00

[58] Field of Search ..... 252/522; 260/598, 586

[56] References Cited

UNITED STATES PATENTS

| | | | |
|---|---|---|---|
| 2,957,933 | 10/1960 | Pommer et al. | 260/598 |
| 3,822,315 | 7/1974 | Klein | 260/586 R |

*Primary Examiner*—Veronica O'Keefe

*Attorney, Agent, or Firm*—Arthur L. Liberman; Harold Haidt; Franklin D. Wolffe

[57] ABSTRACT

Processes and compositions are described for the use in foodstuff, chewing gum, toothpaste and medicinal product flavor and aroma, tobacco flavor and aroma and perfume aroma augmenting, modifying, enhancing and imparting compositions and as foodstuff, chewing gum, toothpaste, medicinal product, tobacco, perfume and perfumed article aroma imparting materials of one or more 2,2,6-trimethyl-1-cyclohexen-1-ylacetaldehyde enol esters (hereinafter referred to as "beta-cyclohomocitral enol esters") having the generic structure:

(which structure is intended to cover both the "cis" and the "trans" isomers thereof) wherein $R_1$ is $C_1$–$C_5$ lower alkyl.

Addition of the one or more beta-cyclohomocitral enol esters to consumable materials is indicated to produce:

a. In foodstuff food flavorings, chewing gums, toothpastes and medicinal products, sweet, fruity, sweet carrot juice, ionone-like, rosey, raspberry, raspberry seed, grape and/or floral aromas with fermented tea and tobacco nuances and sweet vegetable, sweet carrot juice, sweet, fruity, raspberry, ionone-like, woody and/or raspberry kernel tastes with a sweet aftertaste;

b. In tobacco, a sweet, floral, fruity, slightly fatty, aromatic tobacco aroma prior to smoking and a sweet, tobacco-like smoke aroma characteristic in the mainstream on smoking; and c. In perfumes, sweet, fruity, floral, "beta-ionone"-like notes with fermented tea and tobacco aftertastes.

4 Claims, 9 Drawing Figures

EXAMPLE XXXIV

GLC PROFILE OF REACTION PRODUCT CONTAINING "CIS" AND "TRANS" ISOMERS OF β-CYCLOHOMOCITRAL ENOL BUTYRATE.

EXAMPLE XXXIV

GC-MS PROFILE OF REACTION PRODUCT CONTAINING "CIS" AND "TRANS" ISOMERS OF BETACYCLOHOMOCITRAL ENOL BUTYRATE

EXAMPLE XXXIV

EXAMPLE XXXIV

I.R SPECTRUM OF "CIS" ISOMER OF β-CYCLOHOMOCITRAL ENOL BUTYRATE

EXAMPLE XXXIV

IR SPECTRUM OF "TRANS" ISOMER OF β-CYCLOHOMOCITRAL ENOL BUTYRATE

EXAMPLE XXXIV

EXAMPLE XXXV

GLC PROFILE OF REACTION PRODUCT CONTAINING "CIS" AND "TRANS" ISOMERS OF β-CYCLOHOMOCITRAL ENOL BUTYRATE

GLC PROFILE OF REACTION PRODUCT CONTAINING "TRANS" ISOMER OF β-CYCLOHOMOCITRAL ENOL BUTYRATE

EXAMPLE XXXVI

GC-MS PROFILE OF REACTION PRODUCT CONTAINING "TRANS" ISOMER OF β-CYCLOHOMOCITRAL ENOL BUTYRATE

ENOL ESTERS OF AN ALPHA SUBSTITUTED ACETALDEHYDE FRAGRANCE COMPOSITIONS

This application is a continuation-in-part of U.S. Pat. Application Ser. No. 507,412 filed on Sept. 19, 1974 now U.S. Pat. No. 3,940,499 issued Feb. 24, 1976.

BACKGROUND OF THE INVENTION

The present invention relates to 2,2,6-trimethyl-1-cyclohexen-1-ylacetaldehyde enol esters (or beta-cyclohomocitral enol esters) produced by the novel processes of our inventions, and novel compositions using one or more of such beta-cyclohomocitral enol esters to alter, modify or enhance the flavor and/or armoa of consumable materials or impart flavor and/or armoa to consumable materials.

There has been considerable work perfomed relating to substances which can be used to impart (modify, augment or enhance) flavors and fragrances to (or in) various consumable materials. These substances are used to diminish the use of natural materials, some of which may be in short supply and to provide more uniform properties in the finished product. Sweet, sweet vegetable, fruity, raspberry, ionone-like, rosey and raspberry seed aromas as well as sweet, sweet vegetable, sweet carrot juice, fruity, raspberry, ionone-like, woody, and raspberry kernel tastes with sweet aftertastes are particularly desirable for many uses in foodstuff flavors, chewing gum flavors, toothpaste flavors and medicinal product flavors. Sweet, floral and fruity notes are desirable in several types of perfume compositions. Sweet, floral and fruity notes are desirable in tobacco flavoring compositions.

Arctander, "Perfume and Flavor Chemicals", 1969 discloses the use in perfume compositions and flavors of "cyclocitral", "dehydro-beta-cyclocitral", "isocyclocitral", "alpha-cyclocitrylidene acetaldehyde" and "beta-cyclocitrylidene acetaldehyde", thus:

i. "760 CYCLOCITRAL

Alpha-cyclocitral = (2,2,6-trimethyl-5-cyclohexen-1-carboxaldehyde).

beta-cyclocitral = (2,2,6-trimethyl-6-cyclohexen-1-carboxaldehyde). Both isomers are known and have been produced separately.

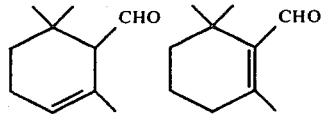

Very rarely offered commercially. These particular cyclocitrals have little or no interest to the creative perfumer, but they have served as part of many pieces of proof that isomers (alpha-beta) do often have different odors."

ii. "761: iso-CYCLOCITRAL

A mixture of two chemicals: 3,5,6-trimethyl-3-cyclohexen-1-carboxaldehyde (meta-cyclocitral).

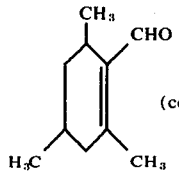

(corrected structure)

2,4,6-trimethyl-4-cyclohexen-1-carboxaldehyde (symmetric-iso-cyclocitral).

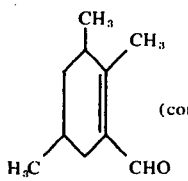

(corrected structure)

Powerful, and diffusive, foliage-green, "dark" weedy and dry odor, sometimes described as "Flower-shop odor". The earthy and wet green notes are quite natural in high dilution and resemble the odor of stems from plants and flowers fresh from the soil.

Finds use in perfume compositions where it blends excellently with Oakmoss products (compensates for sweetness and lifts the topnote), with Ionones (freshness), Geranium and Galbanum (enhances the green and "vegetable" notes ), etc. . . . "

iii. "762: alpha CYCLOCITRYLIDENE ACETALDEHYDE

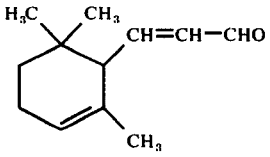

Mild, floral-woody, somewhat oily-herbaceous odor, remotely reminiscent of Rose with similarity to the odor of hydrogenated Ionones.

Suggested for use in perfume compositions. It brings a certain amount of floral lift to Rose compositions, and performs fairly well even in soap. However, the cost of the rarely offered and never readily available lots are rather discouraging to the perfumer, and it is most conceivable that this material can be left out of the perfumer's library without any great loss. . . . "

iv. "763: beta-CYCLOCITRYLIDENE ACETALDEHYDE 2,6,6-trimethyl-l-cyclohexenyl-beta-acrolein.

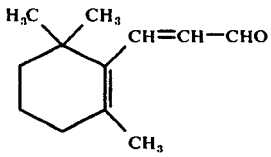

Sweet-woody, rather heavy odor, resembling that of beta-Ionone. More fruity than really floral, but not as tenacious as the Ionone.

Suggested for use in perfume compositions, but since it does not offer any new or unusual odor characteristics, and it cannot be produced in economical competition to beta-Ionone, there is little or no chance that it will ever become a standard shelf ingredient for the perfumer. . . . "

v. "869: DEHYDRO-beta-CYCLOCITRAL (Safranal)

2,6,6-trimethyl-4,4-cyclohexadiene-1-carboxaldehyde

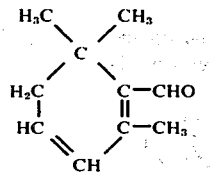

Very powerful, sweet, green-floral and somewhat tobacco-herbaceous odor of good tenacity. In extreme dilution reminiscent of the odor of Safran (Saffron).

Interesting material for fresh topnotes, as a modifier for aldehydic-citrusy notes, as a green-floral topnote in flower fragrances, etc. It blends excellently with the aliphatic Aldehydes, with Oakmoss products and herbaceous oils. . . . "

Safranal and beta-cyclocitral are disclosed as volatile constituents of Greek Tobacco by Kimland et al., Phytochemistry 11 (309) 1972. Beta-cyclocitral is disclosed as a component of Burley Tobacco flavor by Demole and Berthet, Helv. chim. Acta. 55 Fasc 6, 1866 (1972). Methods for producing enol esters are disclosed in the prior art. Thus, for example, heptaldehyde enol acetate is disclosed to be produced according to the process of reacting heptaldehyde with acetic anhydride in the presence of crystalline potassium acetate at reflux temperatures of 155°–160° C by Bedoukian, J.Am.Chem.Soc. 66, August, 1944, pages 1325–1327.

However, no disclosures exist in the prior art indicating the existence or implying the organoleptic uses of beta-cyclohomocitral enol esters or methods for synthesizing such compounds.

THE INVENTION

Figure 1:
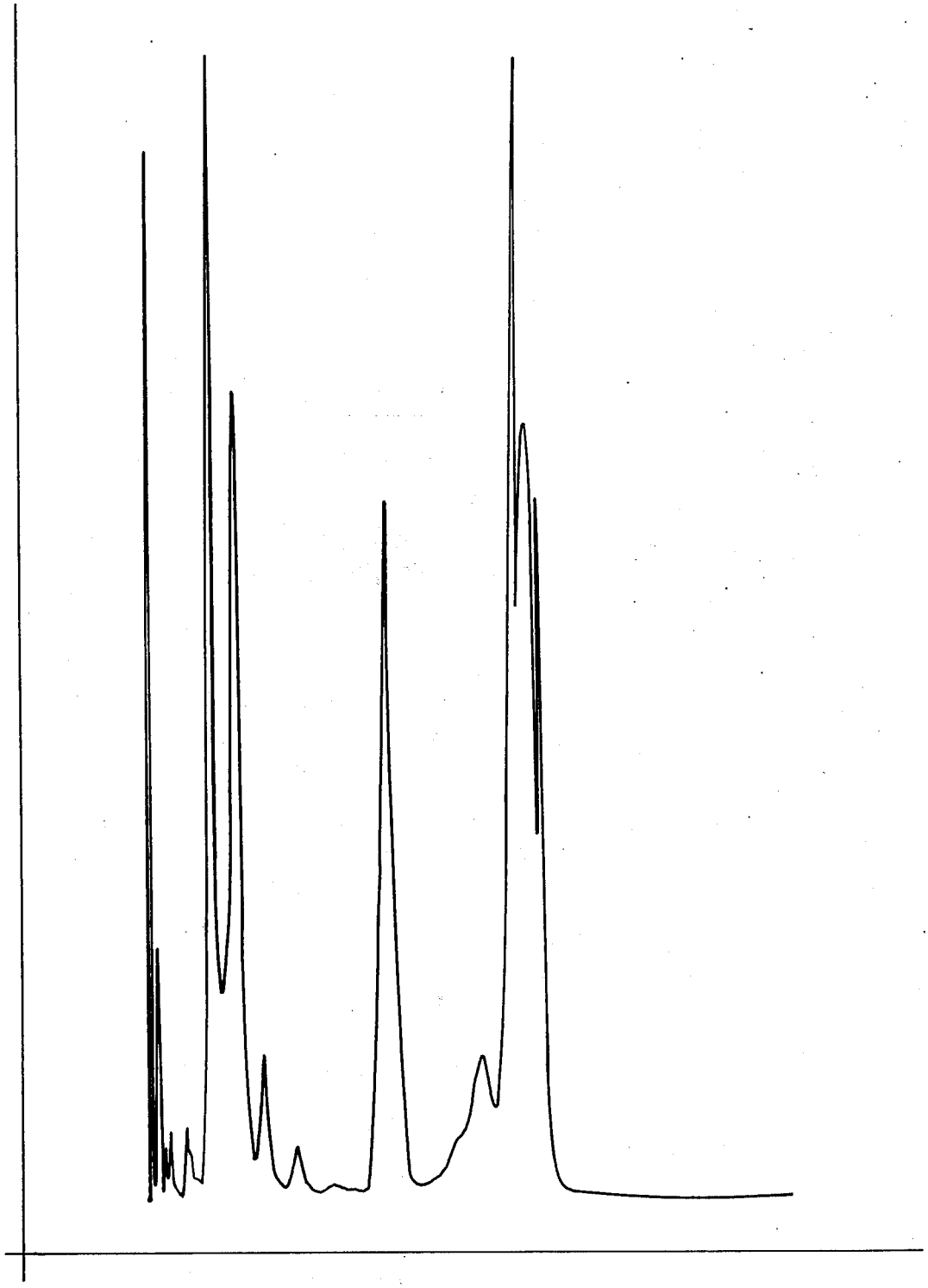
FIG. 1 is the GLC profile for the reaction product of Example XXXIV wherein cis and trans beta-cyclohomocitral enol butyrate is produced.

It has now been discovered that novel solid and liquid foodstuff, chewing gum, medicinal product and toothpaste compositions and flavoring compositions therefor having sweet, fruity, sweet carrot juice, ionone-like, rosey, raspberry, raspberry seed, grape and floral aroma with fermented tea and tobacco nuances and a sweet vegetable, sweet carrot juice, sweet, fruity, raspberry, ionone-like, woody and raspberry kernel tastes, novel perfume compositions and perfumed articles having sweet, floral and fruity notes; as well as novel tobacco and tobacco flavoring compositions having sweet, floral and fruity notes may be provided by the utilization of one or more beta-cyclohomocitral enol esters (either the cis or the trans isomer or a mixture of cis and trans isomers) having the formula:

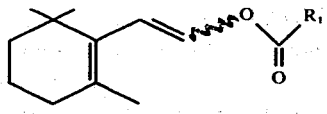

in foodstuffs, chewing gums, toothpastes, medicinal products, perfume compositions, perfumed articles, colognes and tobaccos as well as tobacco substitutes.

The beta-cyclohomocitral enol esters useful as indicated supra may be produced, preferably, by one of several processes.

A first process comprises an oxidation reaction of beta-ionone with either performic acid, peracetic acid or perpropionic acid to form the beta-cyclohomocitral enol acetate.

More specifically, this process comprises the step of reacting beta-ionone having the formula:

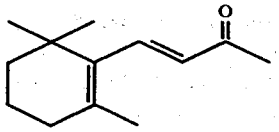

in the absence of substantial quantities of dimethylformamide with a peralkanoic acid having the formula:

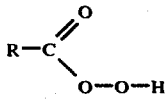

(wherein R is hydrogen, methyl, or ethyl) to form primarily the trans isomer of beta-cyclohomocitral enol acetate having the formula:

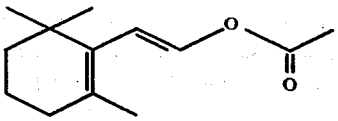

and not the expected beta-ionone epoxide having one of the formulae:

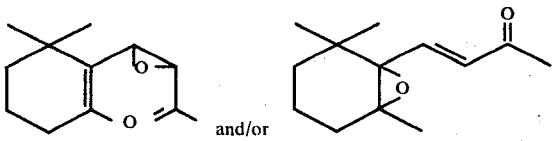

This reaction is preferably carried out in the presence of a buffer such as an alkali metal salt of a lower alkanoic acid or an alkali metal carbonate and in the presence of a lower alkanoic acid such as propionic acid, acetic acid or formic acid with the following provisos:

i. The reaction is preferably carried out at temperatures of from 15° C up to about 75° C. Lower temperatures result in a slower and less complete reaction and temperatures higher than 75° C result in lower yields of the desired product and significantly higher percentages of by-products. The most preferred temperature of reaction is 25° C.

ii. A slight molar excess (from 10 up to 15 percent) of peracetic acid gives a slightly higher yield of product. A large excess (about 200 percent), however, results in the formation of dihydroactinodiolide having the structure:

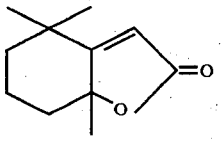

in about 30–35 percent yield when no buffer (e.g., potassium acetate) is present in the reaction mass;

iii. Where potassium carbonate is substituted for potassium acetate as a buffer, the yield of product obtained is substantially the same;

iv. On the other hand, a slightly lower yield of product is obtained by substituting sodium acetate for potassium acetate as the buffer;

v. Substitution of formic acid for acetic acid in the reaction mass gives rise to a lower yield of product.

vi. Any solvent inert to the action of peralkanoic acids may be used in this first oxidation reaction using alkanoic acids. For instance, the use of cyclohexane or chloroform as a solvent does not have an appreciable effect on the yield of product;

viii. Omission of the buffer (i.e., thus performing the reaction under strongly acidic conditions) results in an incomplete reaction, lower yield and greater quantity of by-product (s);

viii. The use of dimethyl formamide as solvent results in the exclusive formation of beta-ionone epoxide having the structure:

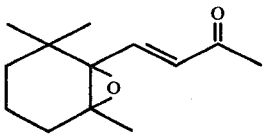

in about 70–75% yield and, accordingly, the presence of substantial quantities of dimethyl formamide must be avoided;

ix. The use of monoperphthalic acid (formed in situ from phthalic anhydride and hydrogen peroxide) yields beta-ionone epoxide in 60–70 percent yield. The use of perbenzoic acid in place of a peralkanoic acid has also been used to make beta-ionone epoxide R.Yves, et al., Helv.Chim.Acta, 29, 880 (1946).

It may be concluded that a peralkanoic acid such as peracetic acid in slight excess in the presence of a buffer system, preferably composed of acetic acid/potassium acetate is the preferred way to oxidize beta-ionone at 25° C to the corresponding enol acetate.

The resultant reaction product, the beta-cyclohomocitral enol acetate (primarily the trans isomer) may then be refined according to standard techniques, e.g., preparative gas chromatography, extraction, distillation and the like as further exemplified herein; or it may be further reacted via an ester interchange raction to form other enol esters thereby carrying out a second process of our invention.

The first process is specific to beta-ionone. As further exemplified infra, when the reaction conditions of this process are applied to alpha-ionone, as opposed to beta-ionone, epoxide formation occurs and, at best a small amount of alpha-cyclohomocitral enol acetate is formed.

A second process comprises reacting the beta-cyclohomocitral enol acetate formed in the first process (set forth supra) with a lower alkanoic acid anhydride in the presence of a paratoluene sulfonic acid catalyst to form a second beta-cyclohomocitral enol ester (a mixture of cis and trans isomers) according to the reaction:

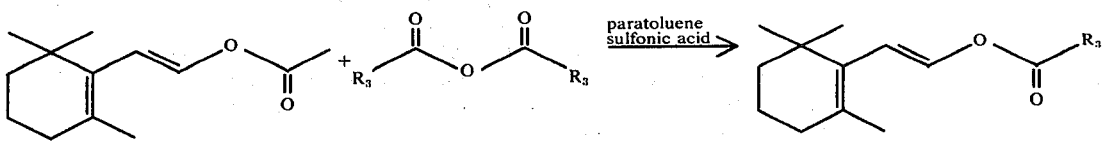

where $R_3$ is $C_2$–$C_5$ alkyl such as ethyl, n-propyl, isopropyl, 1-butyl, 2-butyl, 2-methyl-1-propyl or 2-methyl-2-propyl. This reaction is carried out under reflux conditions over a period of from 5 hours up to 20 hours depending upon the concentration of paratoluene sulfonic acid catalyst. It is preferable that the mole ratio of alkanoic acid anhydride: beta-cyclohomocitral enol acetate be greater than 1 and preferably 1.5:1 because of the necessity to completely react the much more costly enol acetate. The mole ratio of beta-cyclohomocitral enol acetate: paratoluene sulfonic acid catalyst is preferably from 1:0.01 up to 1:0.1 with the most convenient ratio being 1:0.02.

A third process whereby mixtures of cis and trans isomers are formed involves the reaction of beta-cyclohomocitral itself with a lower alkanoic acid anhydride in the presence of either an alkali metal acetate base or a catalytic quantity of paratoluene sulfonic acid according to the following reaction sequence:

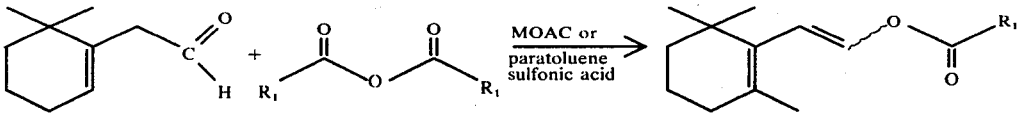

wherein $R_1$ is $C_1$–$C_5$ alkyl such as methyl, ethyl, n-propyl, isopropyl, 1-butyl, 2-butyl, 2-methyl-1-propyl, 2-methyl-2-propyl, 1-pentyl, 2-pentyl, 3-pentyl, 2methyl-1butyl, 2-methyl-2-butyl and 2-methyl-3-butyl and M is alkali metal such as sodium, potassium and lithium. The reaction is carried out at reflux conditions preferably in the absence of any solvent. In all cases, it is preferred that the alkanoic acid anhydride be in molar excess with respect to the beta-cyclohomocitral. It is preferred that the mole ratio of alkanoic acid anhydride: beta-cyclohomocitral be 1.5:1. When the reaction is carried out in the presence of an alkali metal acetate it is preferred that the mole ratio of alkali metal acetate: beta-cyclohomocitral be about 0.1:1. When the reaction is carried out in the presence of alkali metal acetate, it is performed at reflux conditions for a period of from 4 up to 10 hours. When the reaction is carried out using a paratoluene sulfonic acid catalyst it is preferred that the mole ratio of beta-cyclohomocitral: paratoluene sulfonic acid be from 1:0.01 up to 1:0.1 with the most convenient mole ratio being 1:0.02. When using paratoluene sulfonic acid catalyst the reaction is carried out at reflux for a period of time from 10 up to 40 hours depending upon the process economics and desired yield.

One or more of the 2,2,6-trimethyl-1-cyclohexen-1-ylacetaldehyde enol esters (or beta-cyclohomocitral enol esters) of our invention is capable of supplying and/or potentiating certain flavor and aroma notes usually lacking in many fruit flavors as well as tabacco flavors heretofore provided. Furthermore, the beta-cyclohomocitral enol esters of our invention are capable of supplying certain fragrance notes usually lacking in many perfumery materials, for example, rose fragrances.

When the beta-cyclohomocitral enol esters of our invention are used as food flavor adjuvants, the nature of the co-ingredients included with each of the said beta-cyclohomocitral enol esters in formulating the product composition will also serve to alter the organoleptic characteristics of the ultimate foodstuff treated therewith.

As used herein in regard to flavors, the terms "alter", "modify"and "augment " in their various forms mean "supplying or imparting flavor character or note to otherwise bland, relatively tasteless substances or augmenting the existing flavor characteristic where a natural flavor is deficient in some regard or supplementing the existing flavor impression to modify its quality, character or taste".

The term "enhance" is used herein to mean the intensification of a flavor or aroma characteristic or note without the modification of the quality thereof. Thus, "enhancement" of a flavor or aroma means that the enhancement agent does not add any additional flavor note.

As used herein, the term "foodstuff" includes both solids and liquids ingestible materials which usually do, but need not, have nutritional value. Thus, foodstuffs include soups, convenience foods, beverages, dairy products, candies, vegetables, cereals, soft drinks, snacks and the like.

As used herein, the term "medicinal product" includes both solids and liquids which are ingestible non-toxic materials which have medicinal value such as cough syrups, cough drops, aspirin and chewable medicinal tablets.

The term "chewing gum" is intended to mean a composition which comprises a substantially water-insoluble, chewable plastic gum base such as chicle, or substitutes therefor, including jelutong, guttakay, rubber or certain comestible natural or synthetic resins or waxes. Incorporated with the gum base in admixture therewith may be plasticizers or softening agents, e.g., glycerine; and a flavoring composition which incorporates one or more of the beta-cyclohomocitral enol esters of our invention, and in addition, sweetening agents which may be sugars, including sucrose or dextrose and/or artificial sweeteners such as cyclamates or saccharin. Other optional ingredients may also be present.

Substances suitable for use herein as co-ingredients or flavoring adjuvants are well known in the art for such use, being extensively described in the relevant literature. It is a requirement that any such material be "ingestibly"acceptable and thus non-toxic and otherwise non-deleterious particularly from an organoleptic standpoint whereby the ultimate flavor and/or aroma of the consumable material used is not caused to have unacceptable aroma and taste nuances. Such materials may in general be characterized as flavoring adjuvants or vehicles comprise broadly stabilizers, thickeners, surface active agents, conditioners, other flavorants and flavor intensifiers.

Stabilizer compounds include preservatives, e.g., sodium chloride; antioxidants, e.g., calcium and sodium ascorbate, ascorbic acid, butylated hydroxyanisole (mixture of 2 -and 3-tertiary-butyl-4-hydroxyanisole), butylated hydroxy toluene (2,6-di-tertiary-butyl-4-methyl phenol), propyl gallate and the like and sequestrants, e.g., citric acid.

Thickener compounds include carriers, binders, protective colloids, suspending agents, emulsifiers and the like, e.g., agaragar, carrageenan; cellulose and cellulose derivatives such as carboxymethyl cellulose and methyl cellulose; natural and synthetic gums such as gum arabic, gun tragacanth; gelatin, proteinaceous materials; lipids; carbohydrates; starches pectins, and emulsifiers, e.g., mono-and diglycerides of fatty acids, skim milk powder, hexoses, pentoses, disaccharides, e.g., sucrose corn syrup and the like.

Surface active agents include emulsifying agents, e.g., fatty acids such as capric acid caprylic acid, palmitic acid, myristic acid and the like, mono-and diglycerides of fatty acids, lecithin, defoaming and flavor-dispersing agents such as sorbitan monostearate, potassium stearate, hydrogenated tallow alcohol and the like.

Conditioners include compounds such as bleaching and maturing agents, e.g., benzoyl peroxide, calcium peroxide, hydrogen peroxide and the like; starch modifiers such as peracetic acid, sodium chlorite, sodium hypochlorite, propylene oxide, succinic anhydride and the like, buffers and neutralizing agents, e.g., sodium acetate, ammonium bicarbonate, ammonium phosphate, citric acid, lactic acid, vinegar and the like; colorants, e.g., carminic acid, cochineal, tumeric and curcuma and the like; firming agents such as aluminum sodium sulfate, calcium chloride and calcium gluconate; texturizers, anti-caking agents, e.g., aluminum calcium sulfate and tribasic calcium phosphate; enzymes; yeast foods, e.g., calcium lactate and calcium sulfate; nutrient supplements, e.g., iron salts such as ferric phosphate, ferrous gluconate and the like, riboflavin, vitamins, zinc sources such as zinc chloride, zinc sulfate and the like.

Other flavorants and flavor intensifiers include organic acids, e.g., acetic acid, formic acid, 2-hexenoic acid, benzoic acid, n-butyric acid, caproic acid, caprylic acid, cinnamic acid, isobutyric acid, isovaleric acid, alpha-methyl-butyric acid, propionic acid, valeric acid, 2-methyl-2-pentenoic acid, and 2-methyl-3-pentenoic acid; ketones and aldehydes, e.g., acetaldehyde, acetophenone, acetone, acetyl methyl carbinol, acrolein, n-butanal, crotonal, diacetyl, beta, beta-dimethylacrolein, n-hexanal, 2-hexenal, cis-3-hexenal, 2-heptanal, 4-(p-hydroxyphenyl)-2-butanone, alpha-ionone, beta-ionone, methyl-3-butanone, 2-pentanone, 2-pentenal and propanal; alcohols such as 1-butanal, benzyl alcohol, 1-borneol, trans-2-buten-1-ol, ethanol, geraniol, 1-hexanal, 2-heptanol, trans-2-hexenol-1, cis-3-hexen-1-ol, 3-methyl-3-buten-1-ol, 1-pentenol, 1-penten-3-ol, p-hydroxyphenyl-2-ethanol, isoamyl alcohol, isofenchyl alcohol, phenyl-2 -ethanol, alpha-terpineol, cis-terpineol hydrate; esters, such as butyl acetate, ethyl acetate, ethyl acetoacetate, ethyl benzoate, ethyl butyrate, ethyl caproate, ethyl cinnamate, ethyl crotonate, ethyl formate, ethyl isobutyrate, ethyl isovalerate, ethyl alpha-methylbutyrate, ethyl propionate, ethyl salicylate, trans-2-hexenyl acetate, hexyl acetate, 2-hexenyl butyrate, hexyl butyrate, isoamyl acetate, isopropyl butyrate, methl acetate, methyl butyrate, methyl caproate, methyl isobutyrate, alpha-methylbutyrate, propyl acetate, amyl acetate, amyl butyrate, benzyl salicylate, dimethyl anthranilate, ethyl methylphenylglycidate, ethyl succinate, isobutyl cinnamate and terpenyl acetate; essential oils, such as jasmine absolute, rose absolute, orris absolute, lemon essential oil, Bulgarian rose, yara yara and vanilla; lactones; sulfides, e.g., methyl sulfide and other materials such as maltol, acetoin and acetals (e.g., 1,1-diethoxyethane, 1,1-dimethoxyethane and dimethoxymethane).

The specific flavoring adjuvant selected for use may be either solid or liquid depending upon the desired physical form of the ultimate product, i.e., foodstuff, whether simulated or natural, and should, in any event, (i) be organoleptically compatible with the beta-cyclohomocitral enol ester or esters of our invention by not covering or spoiling the organoleptic properties (aroma and/or taste) thereof; (ii) be non-reactive with the beta-cyclohomocitral enol ester or esters of our invention and (iii) be capable of providing an environment in which the beta-cyclohomocitral enol ester or esters can be dispersed or admixed to provide a homogeneous medium. In addition, selection of one or more flavoring adjuvants, as well as the quantities thereof will depend upon the precise organoleptic character desired in the finished product. Thus, in the case of flavoring compositions, ingredient selection will vary in accordance with the foodstuff, chewing gum, medicinal product of toothpaste to which the flavor and/or aroma are to be imparted, modified, altered or enhanced. In contradistinction, in the preparation of solid products, e.g., simulated foodstuffs, ingredients capable of providing normally solid compositions should be selected such as various cellulose derivatives.

As will be appreciated by those skilled in the art, the amount of beta-cyclohomocitral enol ester or esters employed in a particular instance can vary over a relatively wide range, depending upon the desired organoleptic effects to be achieved. Thus, correspondingly, greater amounts would be necessary in those instances wherein the ultimate food composition to be flavored is relatively bland to the taste, whereas relatively minor quantities may suffice for purposes of enhancing the composition merely deficient in natural flavor or aroma. The primary requirements is that the amount selected to be effective, i.e., sufficient to alter, modify or enhance the organoleptic characteristics of the parent composition, whether foodstuff per se, chewing gum per se, medicinal product per se, toothpaste per se, or flavoring composition.

The use of insufficient quantities of beta-cyclohomocitral enol ester or esters will, of course, substantially vitiate any possibility of obtaining the desired results while excess quatities prove needlessly costly and in extreme cases, may disrupt the flavor-aroma balance, thus proving self-defeating. Accordingly, the terminology "effective amount" and "sufficient amount" is to be accorded a significance in the context of the present invention consistent with the obtention of desired flavoring effects.

Thus, and with respect to ultimate food compositions, chewing gum compositions, medicinal product compositions and toothpaste compositions, it is found that quantities of beta-cyclohomocitral enol ester or esters ranging from a small but effective amount. e.g., 0.5 parts per million up to about 100 parts per million based on total composition are suitable. Concentrations in excess of the maximum quantity stated are not normally recommended, since they fail to prove commensurate enhancement of organoleptic properties. In those instances, wherein the beta-cyclohomocitral enol ester or esters is added to the foodstuff as an integral component of a flavoring composition, it is, of course, essential that the total quantity of flavoring composition employed be sufficient to yield an effective beta-cyclohomocitral enol ester concentration in the foodstuff product.

Food flavoring compositions prepared in accordance with the present invention perferably contain the beta-cyclohomocitral enol ester or esters in concentrations ranging from about 0.1% up to about 15% by weight based on the total weight of the said flavoring composition.

The compositions described herein can be prepared according to conventional techniques well known as typified by cake batters and fruit drinks and can be formulated by merely admixing the involved ingredients within the proportions stated in a suitable blender to obtain the desired consistency, homogeneity of dispersion, etc. Alternatively, flavoring compositions in the form of particulate solids can be conveniently prepared by mixing the beta-cyclohomocitral enol ester or esters with, for example, gum arabic, gum tragacanth, carrageenan and the like, and thereafter spray-drying the resultant mixture whereby to obtain the particular solid product. Pre-prepared flavor mixes in powder form, e.g., a fruit-flavored powder mix are obtained by mixing the dried solid components, e.g., starch, sugar and the like and beta-cyclohomocitral enol ester or esters in a dry blender until the requisite degree of uniformity is achieved.

It is presently preferred to combine with the beta-cyclohomocitral enol ester or esters, the following adjuvants:

p-Hydroxybenzyl acetone;
Geraniol;
Acetaldehyde;
Maltol;
Ethyl methyl phenyl glycidate;
Benzyl acetate;
Dimethyl sulfide;
Vanillin;
Methyl cinnamate;
Ethyl pelargonate;
Methyl anthranilate;
Isoamyl acetate;
Isobutyl acetate;
Alpha ionone;
Ethyl butyrate;
Acetic acid;
Gamma-undecalactone;
Naphthyl ethyl ether;
Diacetyl;
Ethyl acetate;
Anethole;
Isoamyl butyrate;
Cis-3-hexenol-1;
2-Methyl-2-pentenoic acid;
Elemecine (4-allyl-1,2,6-trimethoxy benzene);
Isoelemecine (4-propenyl-1,2,6-trimethoxy benzene); and
2-(4-hydroxy-4-methylpentyl) norbornadiene prepared according to U.S. Patent application Ser. No. 461,703 filed on Apr. 17, 1974

An additional aspect of our invention provides an organoleptically improved smoking tobacco product and additives therefor, as well as methods of making the same which overcome specific problems heretofore encountered in which specific desired "sweet, floral and fruity" flavor characteristics of natural tobacco are created or enhanced and may be readily controlled and maintained at the desired uniform level regardless of variations in the tobacco components of the blend.

This invention further provides improved tobacco additives and methods whereby various desirable natural aromatic tobacco flavoring characteristics with sweet, floral and fruity notes may be imparted to smoking tobacco products and may be readily varied and controlled to produce the desired uniform flavoring characteristics.

In carrying out this aspect of our invention, we add to smoking tobacco materials or a suitable substitute therefor (e.g., dried lettuce leaves) an aroma and flavor additive containing as an active ingredient a beta-cyclohomocitral enol ester or esters.

In addition to the beta-cyclohomocitral enol ester or esters of our invention other flavoring and aroma additives may be added to the smoking tobacco material or substitute therefor either separately or in mixture with the beta-cyclohomocitral enol ester or esters as follows:

I. Synthetic Materials

Beta-ethyl-cinnamaldehyde;
Eugenol;
Dipentene;
Damascenone;
Maltol;
Ethyl maltol;
Delta undecalactone;
Delta decalactone;
Benzaldehyde;
Amyl acetate; acetate;
Ethyl butyrate;
Ethyl valerate;
Ethyl acetate;
2-Hexenol-1,2-methyl-5-isopropyl-1,3-nonadiene-8-one;
2,6-Dimethyl-2,6-undecadiene-10-one;
2-Methyl-5-isopropyl acetophenone;
2-Hydroxy-2,5,5,8a-tetramethyl-1-(2-hydroxyethyl)-decahydronaphthalene;
Dodecahydro-3a,6,6,9a-tetramethyl naphtho-(2,1-b)-furan
4-Hydroxy hexanoic acid, gamma lactone;
Polyisoprenoid hydrocarbons defined in Example V of U.S. Pat. No. 3,589,372 issued on June 29, 1971.

II. Natural Oils

Celery seed oil;
Coffee extract;
Bergamot Oil;
Cocoa extract;
Nutmeg oil;
Origanum oil An aroma and flavoring concentrate containing beta-cyclohomocitral enol ester or esters and, if desired, one or more of the above indicated additional flavoring additives may be added to the smoking tobacco material, to the filter or to the leaf or paper wrapper. The smoking tobacco material may be shredded, cured, cased and blended tobacco material or reconstituted tobacco material or tobacco substitutes. (e.g., lettuce leaves) or mixtures thereof. The proportions of flavoring additives may be varied in accordance with taste but insofar as enhancement or the imparting of natural and/or sweet notes, we have found that satisfactory results are obtained if the proportion by weight of the sum total of beta-cyclohomocitral enol ester or esters to smoking tobacco material is between 250 ppm and 1,500 ppm (0.025–0.15%) of the active ingredients to the smoking tobacco material. We have further found that satisfactory results are obtained if the proportion by weight of the sum total of beta-cyclohomocitral enol ester or esters used to flavoring material is between 2,500 and 15,000 ppm (0.25–1.5%).

Any convenient method for incorporating the beta-cyclohomocitral enol ester (or esters) into the tobacco product may be employed. Thus, the beta-cyclohomocitral enol ester (or esters) taken alone or along with other flavoring additives may be dissolved in a suitable solvent such as ethanol, diethyl ether and/or volatile organic solvents and the resulting solution may either be spread on the cured, cased and blended tobacco material or the tobacco material may be dipped into such solution. Under certain circumstances, a solution of the beta-cyclohomocitral enol ester (or esters) taken alone or taken further together with other flavoring additives as set forth above, may be applied by means of a suitable applicator such as a brush or roller on the paper or leaf wrapper for the smoking product, or it may be applied to the filter by either spraying, or dipping, or coating.

Furthermore, it will be apparent that only a portion of the tobacco or substitute therefor need be treated and the thus treated tobacco may be blended with other tobaccos before the ultimate tobacco product is formed. In such cases, the tobacco treated may have the beta-cyclohomocitral enol ester (or esters) in excess of the amounts or concentrations above indicated so that when blended with other tobaccos, the final product will have the percentage within the indicated range.

In accordance with one specific example of our invention, an aged, cured and shredded domestic burley tobacco is spread with a 20% ethyl alcohol solution of beta-cyclohomocitral enol acetate in an amount to provide a tobacco composition containing 800 ppm by weight of beta-cyclohomocitral enol acetate on a dry basis. Thereafter, the alcohol is removed by evaporation and the tobacco is manufactured into cigarettes by the usual techniques. The cigarette when treated as indicated has a desired and pleasing aroma which is detectable in the main and side streams when the cigarette is smoked. This aroma is described as being sweeter, more aromatic, more tobacco-like and having sweet, fruity notes.

While our invention is particularly useful in the manufacture of smoking tobacco, such as cigarette tobacco, cigar tobacco and pipe tobacco, other tobacco products formed from sheeted tobacco dust or fines may also be used. Likewise, the beta-cyclohomocitral enol ester (or esters) of our invention can be incorporated with materials such as filter tip materials, seam paste, packaging materials and the like which are used along with tobacco to form a product adapted for smoking. Furthermore, the beta-cyclohomocitral enol ester (or mixture of esters) can be added to certain tobacco substitutes of natural or synthetic origin (e.g., dried lettuce leaves) and, accordingly, by the term "tobacco" as used throughout this specification is meant any composition intended for human consumption by smoking or otherwise, whether composed of tobacco plant parts or substitute materials or both.

The beta-cyclohomocitral enol ester (or mixture of esters) and one or more auxiliary perfume ingredients, including, for example, alcohols, aldehydes, nitriles, esters, cyclic esters, and natural essential oils, may be admixed so that the combined odors of the individual components produce a pleasant and desired fragrance, particularly and preferably in rose fragrances. Such perfume compositions usually contain (a) the main note or the "bouquet" or foundation stone of the composition; (b) modifiers which round off and accompany the main note; (c) fixatives which include odorous substances which lend a particular note to the perfume throughout all stages of evaporation and substances which retard evaporation; and (d) topnotes which are usually low boiling fresh smelling materials.

In perfume compositions, it is the individual components which contribute to their particular olfactory characteristics, however the over-all sensory effect of the perfume composition will be at least the sum total of the effects of each of the ingredients. Thus, one or more of the beta-cyclohomocitral enol esters can be used to alter, modify or enhance the aroma characteristics of a perfume composition, for example, by utilizing or moderating the olfactory reaction contributed by another ingredient in the composition.

The amount of beta-cyclohomocitral enol ester (or mixture of esters) of our invention which will be effective in perfume compositions as well as in perfumed articles and colognes depend on many factors, including the other ingredients, their amounts and the effects which are desired. It has been found that perfume compositions containing as little as 0.01% of beta-cyclohomocitral enol ester (or mixture of esters) or even less (e.g., 0.005%) can be used to impart a sweet, floral, fruity odor with beta-ionone-like and tobacco-like nuances to soaps, cosmetics or other products. The amount employed can range up to 70% of the fragrance components and will depend on considerations of cost, nature of the end product, the effect desired on the finished product and the particular fragrance sought.

The beta-cyclohomocitral enol ester (or mixture of esters) of our invention is useful, taken alone or in perfume compositions as an olfactory component in detergents and soaps, space odorants and deodorants, perfumes, colognes, toilet water, bath preparations, such as bath oils, and bath solids; hair preparations, such as lacquers, brilliantines, pomades and shampoos; cosmetic preparations, such as creams, deodorants, hand lotions and sun screens; powders, such as talcs, dusting powders, face powders and the like. When used as an olfactory component as little as 1% of beta-cyclohomocitral enol ester will suffice to impart an intense floral note to rose formulations. Generally, no more than 3% of beta-cyclohomocitral enol ester (or mixture of esters) based on the ultimate end product, is required in the perfume composition.

In addition, the perfume composition or fragrance composition of our invention can contain a vehicle, or carrier for the beta-cyclohomocitral enol ester. The vehicle can be a liquid such as an alcohol, a non-toxic alcohol, a non-toxic glycol, or the like. The carrier can also be an absorbent solid, such as a gum (e.g., gum arabic) or components for encapsulating the composition (such as gelatin).

It will thus be apparent that beta-cyclohomocitral enol ester (or mixture of esters) of our invention can be utilized to alter, modify or enhance sensory properties, particularly organoleptic properties, such as flavor(s) and/or fragrance(s) of a wide variety of consumable materials.

Examples I–VIII, X, XVII, XXV and XXVI, following, serve to illustrate processes for producing beta-cyclohomocitral enol esters useful in our invention. Example IX, following, serves to illustrate the unworkability of one of these processes where dimethyl formamide is used in the oxidation reaction of beta-ionone with peracetic acid. Example III, serves to illustrate the unworkability of that reaction where no buffer, e.g., sodium acetate, is used. Example XI–XV, XVIII–XXIV and XXVII–XXXII illustrate the utilities of the beta-cyclohomocitral enol esters of our invention. Example XVI illustrates the unworkability of the above process in forming an alpha-ionone enol ester when operated on alpha-ionone rather than beta-ionone.

It will be understood that these Examples are illustrative and the invention is to be considered restricted thereto only as indicated in the appended claims.

All parts and percentages given herein are by weight unless otherwise specified.

EXAMPLE I

Production of Beta-Cyclohomocitral Enol Acetate From Beta-Ionone

Into a 2 liter reaction flask equipped with stirrer, thermometer, reflux condenser, addition funnel and cooling bath, the following materials are added:

i. Solution of 96 grams beta-ionone in 300 cc chloroform;

ii. 30 grams sodium acetate

95 Grams of 40 percent peracetic acid is then added, with cooling, slowly at 10° C during a period of 1 hour. The reaction mass is stirred at 10° C for an additional hour and the solution is then allowed to slowly warm up to room temperature. The reaction mass is then poured into 1 liter of water and the resultant organic and aqueous phases are separated. The aqueous phase if then extracted with 100 cc of chloroform and the resultant organic phases are then bulked. The solvent is evaporated from the organic phase to yield 99.5 grams of an oil which is then chromatographed on 1,000 grams of alumina deactivated with 5% w/w water and eluted as follows:

| Fraction | Volume of Solvent | Quantity of Solute Eluted |
|---|---|---|
| 1 | 750 cc hexane | 8.0 grams |
| 2 | 500 cc hexane | 31.7 grams |
| 3 | 300 cc hexane | 13.5 grams |
| 4 | 250 cc hexane | 7.0 grams |
| 5 | 250 cc hexane | 1.9 grams |
| 6 | 250 cc hexane | 1.6 grams |
| 7 | 600 cc 25% diethyl ether–75% hexane | 15.6 grams |
| 8 | 600 cc diethyl ether | 15.3 grams |

Fractions 1–4 are composed mainly of beta-ionone enol acetate.

The special data for a purified sample of this material obtained by preparative gas chromatography confirm the structure:

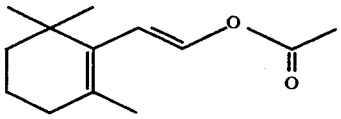

The mass spectrum of this compound has the following fragmentation pattern, in decreasing order of ion abundance: m/e 166 (100), 151 (81), 43 (30), 208 (30) (molecular ion) and 95 (18). The infrared spectrum shows the following characteristic absorption bands ($cm^{-1}$):

| | |
|---|---|
| 3090 | H, C=C, H (C—H) |
| 1752 | C=O (vinyl ester) |
| 1650 | C=C (conjugated with oxygen) |
| 1360 | $CH_3$, C, $CH_3$ |
| 1380 | $CH_3$ |
| 1365 | —$CH_3$ |
| 1215 | C—O (of the ester) |
| 1080 | |
| 930 | H, C=C, H |

The NMR spectrum exhibits in $CDCl_3$ solution the following proton absorptions (chemical shifts in ppm):

| Ppm | Multiplicity | Assignment | No. of Protons |
|---|---|---|---|
| 1.00 | (s) | $CH_3$, $CH_3$, C | 6H |
| 1.70–1.40 | (m) | | |
| 1.76 | (s) | $[CH_2]$, =C—$CH_3$ | 7H |
| 2.00 | (t) | =C—$CH_2$— | 2H |
| 2.16 | (s) | $CH_3$—C(=O)—O | 3H |
| 5.86 and 7.20 | (m) | Olefinic protons | 2H |

EXAMPLES II–X

The following examples, carried out using the same procedure as Example I, illustrate the results which occur when parameters of the oxidation reaction of beta-ionone with peracetic acid are varied, e.g., as to buffer, solvent, temperature presence of organic base and ratio of organic alkanoic acid to peracetic acid. The percentages given are obtained by gas chromatographic analyses of the reaction mixture after 30 minutes and do not represent yields of isolated material.

| Example No. | % Enol Ester | % Starting Material | % By-Products | Reactants and Reaction Conditions |
|---|---|---|---|---|
| II | 47 | 24 | 29 | Acetic acid-(150 cc) Sodium acetate (20 g ) Beta-ionone-(30 g) 40% peracetic acid-(30 g) Temperature: 25° C. |
| III | 12 | 52 | 36 | Acetic acid-(150 g) Beta-ionone-(30 g) 40% peracetic acid-(30 g) Temperature: 25° C. |
| IV | 40 | 29 | 31 | Cyclohexane-(150 cc) Sodium acetate-(20 g) Beta-ionone-(30 g) 40% peracetic acid (30 g) Temperature: 25° C |
| V | 52 | 26 | 22 | Acetic acid-(150 cc) Potassium acetate (35 g) Beta ionone-(30 g) 40% peracetic |

-continued

| Example No. | % Enol Ester | % Starting Material | % By-Products | Reactants and Reaction Conditions |
|---|---|---|---|---|
| | | | | acid (30 g) Temperature: 25° C |
| VI | 31 | 30 | 39 | Formic acid-(150 cc) Potassium acetate-(50 g) Beta-ionone-(30 g) 40% peracetic acid (30 g) Temperature: 25° C |
| VII | 49 | 6 | 45 | Acetic acid-(150 cc) Potassium acetate-(35 g) Beta-ionone-(30 g) 40% Peracetic acid (33 g) Temperature: 25° C |
| VIII | 36 | 21 | 43 | Acetic acid-(150 cc) Potassium acetate-(35 g) Beta-ionone-(30 g) 40% Peracetic acid-(33 g) Temperature: 50° C |
| IX | 0 | 9 | 91 Beta-ionone epoxide | Dimethyl formamide (150 cc) Beta-ionone-(30 g) 40% peracetic acid-(33 g) Temperature: 4 days at a temperature of 18° C. |
| X | 55 | 17 | 28 | Acetic acid-(450 cc) Potassium acetate-(105 g) Beta-ionone-(96 g) 40% peracetic acid-(105 g) Temperature: 25° C. |

EXAMPLE XI

Rose Formulation

To demonstrate the use of beta-cyclocitral enol acetate in a rose formulation, the following formula is provided.

| Ingredient | Parts by Weight |
|---|---|
| Phenylethyl alcohol | 200 |
| Geraniol | 400 |
| Trichloromethylphenyl carbinyl acetate | 20 |
| Phenylethyl acetate | 60 |
| Undecylenic aldehyde (10% in diethyl phthalate) | 5 |
| n-Nonyl aldehyde (10% in diethyl phthalate) | 2 |
| Musk ketone | 10 |
| Musk ambrette | 10 |
| Eugenol phenyl acetate | 20 |
| Citronellol | 100 |
| Vanillin (10% in diethyl phthalate) | 6 |
| Eugenol | 30 |
| Citronellyl formate | 30 |
| Geranyl acetate | 10 |
| Linalool | 40 |
| Geranyl phenyl acetate | 50 |
| cis beta, γ-hexenyl acetate | 2 |
| beta-cyclohomocitral enol acetate | 5 |

-continued

| Ingredient | Parts by Weight |
|---|---|
| | 1000 |

The addition of 0.5% of beta-cyclohomocitral enol acetate lends a great deal of strength and character to the rose fragrance. It contributes great floralcy and the heady natural sweetness of the red rose flower.

At lower concentrations (0.01%) its contribution is more subtle, however, it still gives an interesting natural effect.

This product may normally be used from approximately 0.01 to 10% in perfume compositions. For special effects, however, higher concentrations (50% plus) can be used.

EXAMPLE XII

Preparation of a Soap Composition

100 Grams of soap chips are mixed with one gram of the perfume composition of Example XI until a substantially homogeneous composition is obtained. The perfumed soap composition manifests an excellent rose character with excellent sweet, floral and fruity notes.

EXAMPLE XIII

Preparation of a Detergent Composition

A total of 100 grams of detergent powder is mixed with 0.15 grams of the perfume composition of Example XI, until a substantially homogeneous composition is obtained. This composition has an excellent rose aroma with sweet, floral and fruity notes.

EXAMPLE XIV

Raspberry Flavor Formulation

The following basic raspberry flavor formulation is produced:

| Ingredient | Parts by Weight |
|---|---|
| Vanillin | 2.0 |
| Maltol | 5.0 |
| Parahydroxybenzylacetone | 5.0 |
| Alpha-ionone (10% in propylene glycol) | 2.0 |
| Ethyl Butyrate | 6.0 |
| Ethyl Acetate | 16.0 |
| Dimethyl Sulfide | 1.0 |
| Isobutyl Acetate | 13.0 |
| Acetic Acid | 10.0 |
| Acetaldehyde | 10.0 |
| Propylene Glycol | 930.0 |

Beta-cyclohomocitral enol acetate is added to half of the above formulation at the rate of 2.0%. The formulation with the beta-cyclohomocitral enol acetate is compared with the formulation without the beta-cyclohomocitral enol acetate at the rate of 0.01 percent (100 ppm) in water and evaluated by a bench panel.

The flavor containing the beta-cyclohomocitral enol acetate is found to have substantially sweeter aroma notes and a sweet raspberry, raspberry kernel-like and sweet aftertaste and mouthfeel missing in the basic raspberry formulation. It is the unanimous opinion of the bench panel that the chemical, beta-cyclohomocitral enol acetate rounds the flavor out and contributes to a very natural fresh aroma and taste as found in full ripe raspberries. Accordingly, the flavor with the addition of the beta-cyclohomocitral enol acetate is considered as substantially better than the flavor without beta-cyclohomocitral enol acetate.

EXAMPLE XV

"Eveready" canned carrot juice, manufactured by the Dole Corporation of San Jose, Calif., is intimately admixed with 15 ppm of beta-cyclohomocitral enol acetate and the resulting mixture is compared with same juice unflavored. The weak aroma and taste of the juice is substantially improved whereby a fresh carrot juice and pleasant sweet note are added thereto. A bench panel of five people prefers the carrot juice flavored with beta-cyclohomocitral enol acetate as compared with the unflavored carrot juice.

EXAMPLE XVI

Formation of Alpha-Ionone Epoxide From Alpha-Ionone

Into a 500 ml flask equipped with thermometer, stirrer, addition funnel and reflux condenser, the following materials are placed in the following order:

| Ingredients | Amount |
|---|---|
| Acetic Acid | 150 cc |
| Potassium Acetate | 35 grams |
| Alpha-Ionone | 30 grams |

33 Grams of 40% peracetic acid is then added dropwise into the reaction mass with stirring at 25° C over a 45-minute period. The reaction mass exotherms for approximately one hour and is then allowed to remain at room temperature for a period of 15 hours.

The reaction mass is then poured into 500 ml water and the product is extracted with three 150 cc portions of diethyl ether. The ether extracts are combined and washed with two 100 cc portions of saturated sodium chloride solution and dried over anhydrous magnesium sulfate. The residual oil obtained after stripping the solvent, is distilled at 93°–99° C at 0.5 mm Hg pressure yielding 28.3 g of a clean colorless liquid.

IR, MS and NMR analyses confirm the fact that the product is alpha-ionone epoxide having the structure:

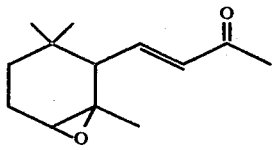

EXAMPLE XVII

Production of Beta-Cyclohomocitral Enol Acetate

Into a 2 liter reaction flask equipped with stirrer, thermometer, addition funnel and cooling bath, the following materials are placed in the following order:

| Ingredients | Amounts |
|---|---|
| Acetic Acid | 450 cc |
| Potassium Acetate | 105 g |
| Beta-Ionone | 96 g |

105 Grams of 40% peracetic acid is then added dropwise to the reaction mass with cooling while maintaining the reaction mass at 25° ± 2° C over a period of 2 hours. The reaction mass is then stirred for an additional 3-hour period (during the first hour a slight exotherm occurs) at 25° C.

The reaction mass is then poured into 1,000 ml water and the resultant product is extracted with three 300 cc volumes of diethyl ether. The ether extracts are combined and washed with two 150 cc portions of saturated sodium chloride solution. The resultant washed ether extract is then evaporated whereby 118 grams of residual oil is obtained. NMR, IR and Mass Spectral analyses confirm that the resulting material is beta-cyclohomocitral enol acetate.

EXAMPLE XVIII

Tobacco Formulation

A tobacco mixture is produced by admixing the following ingredients:

| Ingredient | Parts by Weight |
|---|---|
| Bright | 40.1 |
| Burley | 24.9 |
| Maryland | 1.1 |
| Turkish | 11.6 |
| Stem (flue-cured) | 14.2 |
| Glycerine | 2.8 |
| Water | 5.3 |

Cigarettes are prepared from this tobacco.

The following flavor formulation is prepared:

| Ingredient | Parts by Weight |
|---|---|
| Ethyl butyrate | .05 |
| Ethyl valerate | .05 |
| Maltol | 2.00 |
| Cocoa extract | 26.00 |
| Coffee extract | 10.00 |
| Ethyl alcohol | 20.00 |
| Water | 41.90 |

The above-stated tobacco flavor formulation is applied at the rate of 0.1% to all of the cigarettes produced using the above tobacco formulation. Half of the cigarettes are then treated with 500 or 1,000 ppm of beta-cyclohomocitral enol acetate produced according to the process of Example XVII. The control cigarettes not containing the beta-cyclohomocitral enol acetate produced according to the process of Example XVII and the experimental cigarettes which contain the beta-cyclohomocitral enol acetate produced according to the process of Example XVII are evaluated by paired comparison and the results are as follows:

The experimental cigarettes are found to have more body and to be, on smoking, sweeter, more aromatic, more tobacco-like and less harsh with sweet, floral and fruity notes.

The tobacco of the experimental cigarettes, prior to smoking, has sweet, floral and fruity notes. All cigarettes are evaluated for smoke flavor with a 20 mm cellulose acetate filter.

The beta-cyclohomocitral enol acetate produced according to the process of Example XVII enhances the tobacco-like taste and aroma of the blended cigarette imparting to it sweet, natural tobacco notes.

EXAMPLE XIX

PREPARATION OF A COSMETIC-POWDER COMPOSITION

A cosmetic powder is prepared by mixing in a ball mill, 100 g of talcum powder with 0.25 g of beta-cyclohomocitral enol acetate prepared according to Example XVII. It has an excellent sweet, floral, fruity aroma.

EXAMPLE XX

Perfumed Liquid Detergent

Concentrated liquid detergents with a sweet, floral, fruity odor are prepared containing 0.10%, 0.15% and 0.20% of beta-cyclohomocitral enol acetate prepared according to Example XVII. They are prepared by adding and homogeneously mixing the appropriate quantity of beta-cyclohomocitral enol acetate in the liquid detergent. The detergents all possess a sweet, floral, fruity fragrance, the intensity increasing with greater concentrations of beta-cyclohomocitral enol acetate.

EXAMPLE XXI

Preparation of a Cologne and Handkerchief Perfume

Beta-cyclohomocitral enol acetate prepared according to the process of Example XVII is incorporated in a cologne at a concentration of 2.5% in 85% aqueous ethanol; and into a handkerchief perfume at a concentration of 20% (in 95% aqueous ethanol). A distinct and definite sweet, floral, fruity fragrance is imparted to the cologne and to the handkerchief perfume.

EXAMPLE XXII

Preparation of a Cologne And Handkerchief Perfume

The composition of Example XI is incorporated in a cologne at a concentration of 2.5% in 85% aqueous ethanol; and into a handkerchief perfume at a concentration of 20% (in 95% aqueous ethanol). The use of the beta-cyclohomocitral enol acetate in the composition of Example XI affords a distinct and definite strong rose aroma with sweet, floral, fruity notes to the handkerchief perfume and cologne.

EXAMPLE XXIII

Preparation of Soap Composition

One hundred grams of soap chips are mixed with one gram of beta-cyclohomocitral enol acetate until a substantially homogeneous composition is obtained. The perfumed soap composition manifests an excellent sweet, floral, fruity aroma.

EXAMPLE XXIV

Preparation of a Detergent Composition

A total of 100 g of a detergent powder is mixed with 0.15 g of the beta-cyclohomocitral enol acetate of Example XVII until a substantially homogeneous composition is obtained. This composition has an excellent sweet, floral, fruity aroma.

EXAMPLE XXV

Perpropionic acid is prepared in the following manner. A mixture of the following materials:

| | |
|---|---|
| 160 ml propionic acid<br>1 ml sulfuric acid (concentrated)<br>40 g 50% hydrogen peroxide | Referred to hereinafter as "Mixture A" |

is allowed to stand for 20 hours at room temperature.

The following reactants are placed in a 500 ml reaction flask equipped with a stirrer and cooling bath:

| | |
|---|---|
| 140 ml propionic acid<br>75 g potassium acetate<br>60 g beta-ionone | Referred to hereinafter as "Mixture B" |

To the stirred Mixture 3 is added, dropwise, Mixture A over a 60-minute period while maintaining the reaction temperature at 25° ± 2° C by means of external cooling. When the addition is complete the reaction mixture is stirred for an additional 2 hours at 25° C.

The reaction mixture is then poured into 1,000 ml water and extracted twice with 250 ml portions of diethyl ether. The combined ether extracts are then washed first with water (three 100 ml portions) and then with a saturated solution of sodium chloride (150 ml). The ether solution is then dried over anhydrous magnesium sulfate and the solvent evaporated to yield 78 g of crude oil containing propionic acid as well as the product, beta-cyclohomocitral enol acetate.

EXAMPLE XXVI

Performic acid is prepared in the following manner: 20 g 50% hydrogen peroxide and 80 ml of formic acid is admixed and the reaction mass is left at room temperature for 1.5 hours.

To a mixture consisting of 50 g of potassium acetate, 70 ml of acetic acid and 30 g of beta -ionone is added the performed performic acid, prepared as described above, dropwise over a 30 minute period while maintaining the temperature of the stirred reaction mass at 25° C by means of external cooling. After the addition is complete, the mixture is stirred for a further 90 minutes at 25° C and is then poured into 800 ml of water. The product is extracted with two 200 ml portions of diethyl ether. The ether extracts are combined, washed with two 150 ml portions of saturated sodium chloride solution and then dried. Removal of the solvent by evaporation yields 32.5 g crude oil.

A gas chromatographic analysis of this material shows the following compositions:

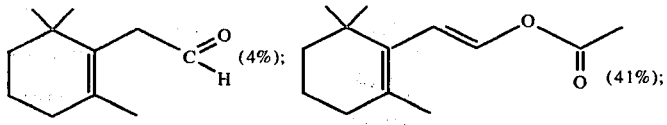

-continued

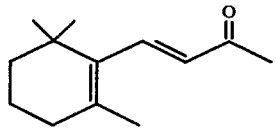

(32%); Other products 23%

EXAMPLE XXVII

A. Powder Flavor Composition

20 Grams of the flavor composition of Example XIV is emulsified in a solution containing 300 gm gum acacia and 700 gm water. The emulsion is spray-dried with a Bowen Lab Model Drier utilizing 260 c.f.m. of air with an inlet temperature of 500° F., an outlet temperature of 200° F., and a wheel speed of 50,000 r.p.m.

B. Sustained Release Flavor

The following mixture is prepared:

| Ingredient | Parts by Weight |
|---|---|
| Liquid Raspberry Flavor Composition of Example XIV | 20 |
| Propylene glycol | 9 |
| Cab-O-Sil M-5 (Brand of Silica produced by the Cabot Corporation of 125 High Street, Boston, Mass. 02110; Physical Properties: Surface Area: 200 m²/gm Nominal particle size: 0.012 microns Density: 2.3 lbs/cu.ft.) | 5.00 |

The Cab-O-Sil is dispersed in the liquid rasberry flavor composition of Example XIV with vigorous stirring, thereby resulting in a viscous liquid. 71 Parts by weight of the powder flavor composition of Part A, supra, is then blended into the said viscous liquid, with stirring at 25° C for a period of 30 minutes resulting in a dry, free flowing sustained release flavor powder.

EXAMPLE XXVIII

10 Parts by weight of 50 Bloom pigskin gelatin is added to 90 parts by weight of water at a temperature of 150° F. The mixture is agitated until the gelatin is completely dissolved and the solution is cooled to 120° F. 20 Parts by weight of the liquid flavor composition of Example XIV is added to the solution which is then homogenized to form an emulsion having particle size typically in the range of 2–5 microns. This material is kept at 120° F. under which conditions the gelatin will not jell.

Coascervation is induced by adding, slowly and uniformly 40 parts by weight of a 20% aqueous solution of sodium sulphate. During coascervation, the gelatin molecules are deposited uniformly about each oil droplet as a nucleus.

Gelation is effected by pouring the heated coascervate mixture into 1,000 parts by weight of 7% aqueous solution of sodium sulphate at 65° F. The resulting jelled coascervate may be filtered and washed with water at temperatures below the melting point of gelatin, to remove the salt.

Hardening of the filtered cake, in this example, is effected by washing with 200 parts by weight of 37% solution of formaldehyde in water. The cake is then washed to remove residual formaldehyde.

EXAMPLE XXIX

Chewing Gum 100 parts by weight of chicle are mixed with 4 parts by weight of the flavor prepared in accordance with Example XXVII. 300 parts of sucrose and 100 parts of corn syrup are added. Mixing is effected in a ribbon blender with jacketed side walls of the type manufactured by the Baker Perkins Co.

The resultant chewing gum blend is then manufactured into strips 1 inch in width and 0.1 inches in thickness. The strips are cut into lengths of 3 inches each. On chewing, the chewing gum has a pleasant long lasting raspberry flavor.

EXAMPLE XXX

Chewing Gum 100 parts by weight of chicle are mixed with 18 parts by weight of the flavor prepared in accordance with Example XXVIII. 300 parts of sucrose and 100 parts of corn syrup are then added. Mixing is effected in a ribbon blender with jacketed side walls of the type manufactured by the Baker Perkins Co.

The resultant chewing gum blend is then manufactured into strips 1 inch in width and 0.1 inches in thickness. The strips are cut into lengths of 3 inches each. On chewing, the chewing gum has a pleasant long lasting raspberry flavor.

EXAMPLE XXXI

Toothpaste Formulation

The following separate groups of ingredients are prepared:

| Parts by Weight | Ingredient |
|---|---|
| Group "A" | |
| 30.200 | Glycerin |
| 15.325 | Distilled Water |
| .100 | Sodium Benzoate |
| .125 | Saccharin Sodium |
| .400 | Stannous Fluoride |
| Group "B" | |
| 12.500 | Calcium Carbonate |
| 37.200 | Dicalcium Phosphate (Dihydrate) |
| Group "C" | |
| 2.000 | Sodium N-Lauroyl Sarcosinate (foaming agent) |
| Group "D" | |
| 1.200 | Flavor Material of Example XXVII |

-continued

| Parts by Weight | Ingredient |
|---|---|
| 100.00 (Total) | |

PROCEDURE:

1. The ingredients in Group "A" are stirred and heated in a steam jacketed kettle to 160° F.
2. Stirring is continued for an additional three to five minutes to form a homogenous gel.
3. The powders of Group "B" are added to the gel, while mixing until a homogenous paste is formed.
4. With stirring, the flavor of "D" is added and lastly the sodium n-lauroyl sarcosinate.
5. The resultant slurry is then blended for one hour. The completed paste is then transferred to a three roller mill and then homogenized, and finally tubed.

The resulting toothpaste when used in a normal toothbrushing procedure yields a pleasant raspberry flavor, of constant strong intensity throughout said procedure (1–1.5 minutes).

EXAMPLE XXXII

Chewable Vitamin Tablets

The flavor material produced according to the process of Example XIX is added to a Chewable Vitamin Tablet Formulation at a rate of 10 gm/gm which Chewable Vitamin Tablet Formulation is prepared as follows:

In a Hobart Mixer, the following materials are blended to homogeneity:

| | Gms/1000 tablets |
|---|---|
| Vitamin C (ascorbic acid) as ascorbic acid-sodium ascorbate mixture 1:1 | 70.0 |
| Vitamin $B_1$ (thiamine mononitrate) as Rocoat thiamine mononitrate 33 -% (Hoffman La Roche) | 4.0 |
| Vitamin $B_2$ (riboflavin) as Rocoat riboflavin 33 ⅓% | 5.0 |
| Vitamin $B_6$ (pyridoxine hydrochloride) as Rocoat pyridoxine hydrochloride 33 ⅓% | 4.0 |
| Niacinamide as Rocoat niacinamide 33 ⅓% | 33.0 |
| Calcium pantothenate | 11.5 |
| Vitamin $B_{12}$ (cyanocobalamin) as Merck 0.1% in gelatin | 3.5 |
| Vitamin E (di-alpha-tocopheryl acetate) as dry Vitamin E acetate 33 ⅓% Roche | 6.6 |
| d-Biotin | 0.044 |
| Certified lake color | 5.0 |
| Flavor of Example XXVIII | 5.0 |
| Sweetener – sodium saccharin | 1.0 |
| Magnesium stearate lubricant | 10.0 |
| Mannitol g.s. to make | 500.0 |

Preliminary tablets are prepared by slugging with flat-faced punches and grinding the slugs to 14 mesh. 13.5 g dry Vitamin A Acetate and 0.6 g Vitamin D are then added as beadlets. The entire blend is then compressed using concave punches at 0.5 g each.

Chewing of the resultant tablets yields a pleasant, long-lasting, consistently strong raspberry flavor for a period of 12 minutes.

EXAMPLE XXXIII

Chewing Tobacco

Onto 100 pounds of tobacco for chewing (85% Wisconsin leaf and 15% Pennsylvania leaf) the following casing is sprayed at a rate of 30%:

| Ingredients | Parts by Weight |
|---|---|
| Corn Syrup | 60 |
| Licorice | 10 |
| Glycerine | 20 |
| Fig Juice | 4.6 |
| Prune Juice | 5 |
| Flavor Material of Example XXVII | 0.4 |

The resultant product is redried to a moisture content of 20%. On chewing, this tobacco has an excellent substantially consistent, long-lasting raspberry (20 minutes) nuance in conjunction with the main fruity tobacco note.

EXAMPLE XXXIV

Production of Beta-Cyclohomocitral Enol Butyrate

Reaction:

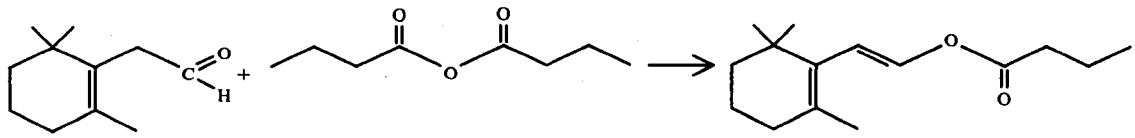

Into a 100 ml reaction flask are added the following materials:

| | |
|---|---|
| beta-cyclohomocitral | 16.6 g (0.1 moles) |
| butyric anhydride | 27 g (0.17 moles) |
| potassium acetate | 1 g (0.01 moles) |

The reaction mass is heated at a temperature of 170° C for a period of 9.5 hours. At this period in time GLC analysis indicates the substantially total disappearance of the beta-cyclohomocitral and the formation of two new peaks. GC-MS analysis indicates that the peaks represent the cis and trans isomers of beta-cyclohomocitral enol butyrate having the structure:

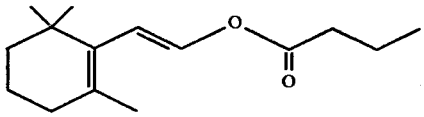

The GLC profile is set forth in FIG. 1 (conditions: 10 feet × ⅛ inch Carbowax 20 M column, programmed from 80°–180° C at 4° C per minute).

Figure 2:
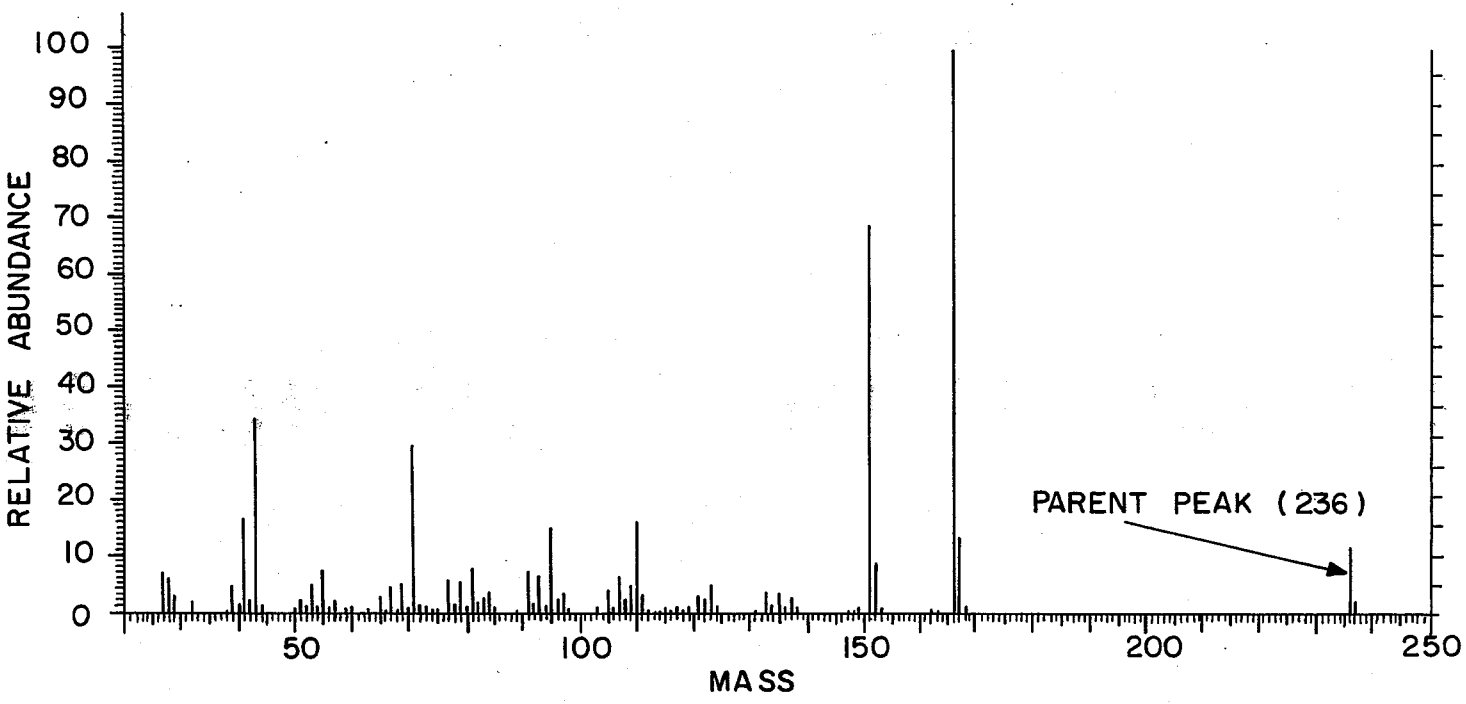
FIG. 2 is the GC-MS profile for the reaction product produced in Example XXXIV.

The GC-MS profile is set forth in FIG. 2.

The NMR analysis of the cis isomer of beta-cyclohomocitral enol butyrate is as follows:

| | | | |
|---|---|---|---|
| 0.97 ppm | singlet superimposed on triplet | $CH_3$ \ C — / $CH_3$ and $CH_3-C(=O)-C$ | 9H |
| 1.54 | broad singlet | $=C-CH_3$ | 9H |
| 1.78–1.21 | multiplet | $-(CH_2)_3-$ | |
| 2.00 | diffuse triplet | $=C-CH_2-$ | 2H |
| 2.35 | triplet | $-CH_2-C(=O)-O-$ | 2H |
| 5.32 | doublet (J=7Hz,cis) | $HC(H)=C-O-$ | 1H |
| 7.06 | doublet | | 1H |

Figure 3:
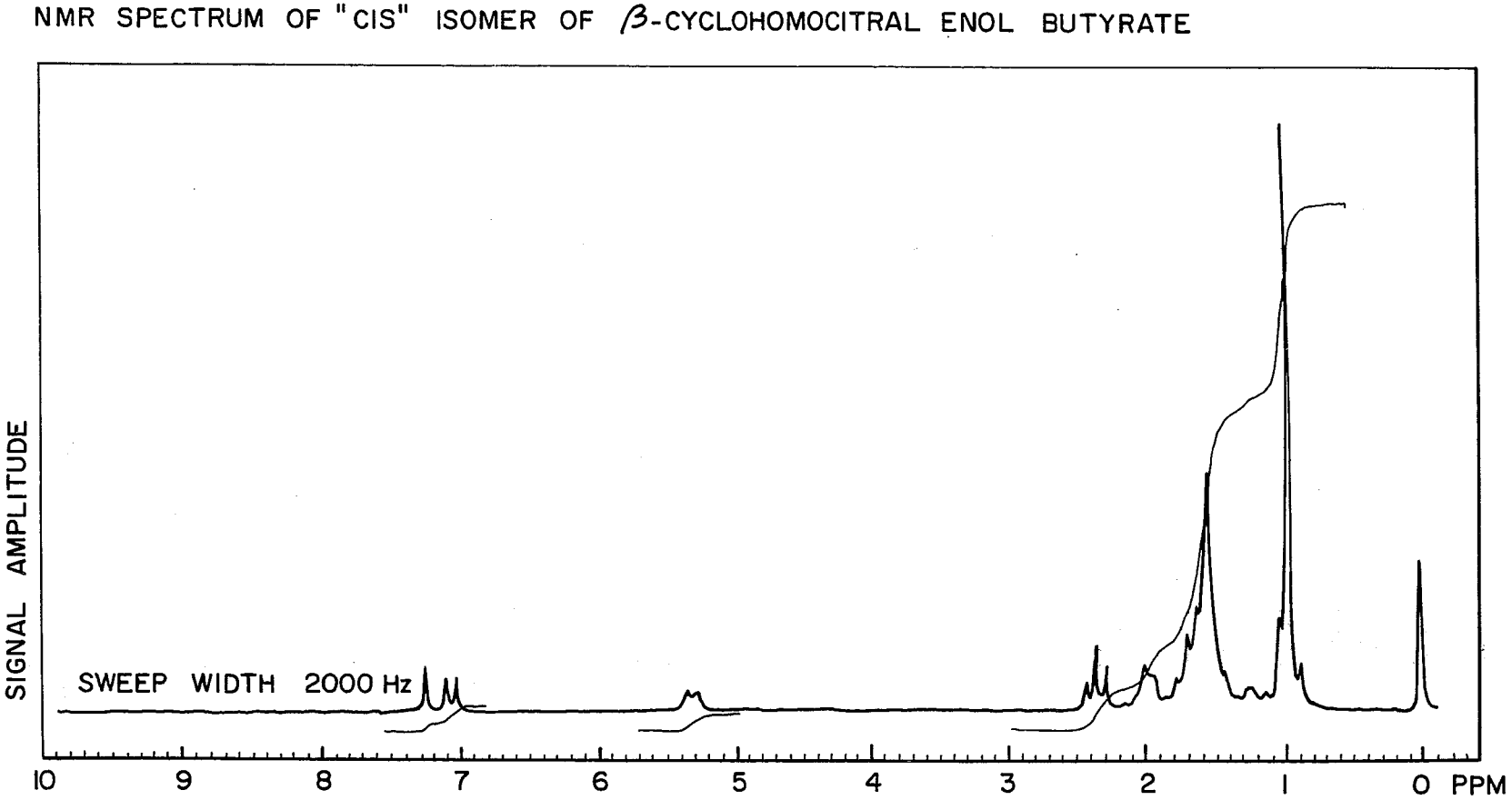
FIG. 3 is the NMR spectrum for the cis isomer of beta-cyclohomocitral enol butyrate produced according to Example XXXIV.

The NMR spectrum for the cis isomer of beta-cyclohomocitral enol butyrate is set forth in FIG. 3.

The Infrared analysis for the cis isomer of beta-cyclohomocitral enol butyrate is as follows:

740, 1085, 1160, 1230, 1360, 1750, 2870, 2940, 2960 $cm^{-1}$

Figure 4:
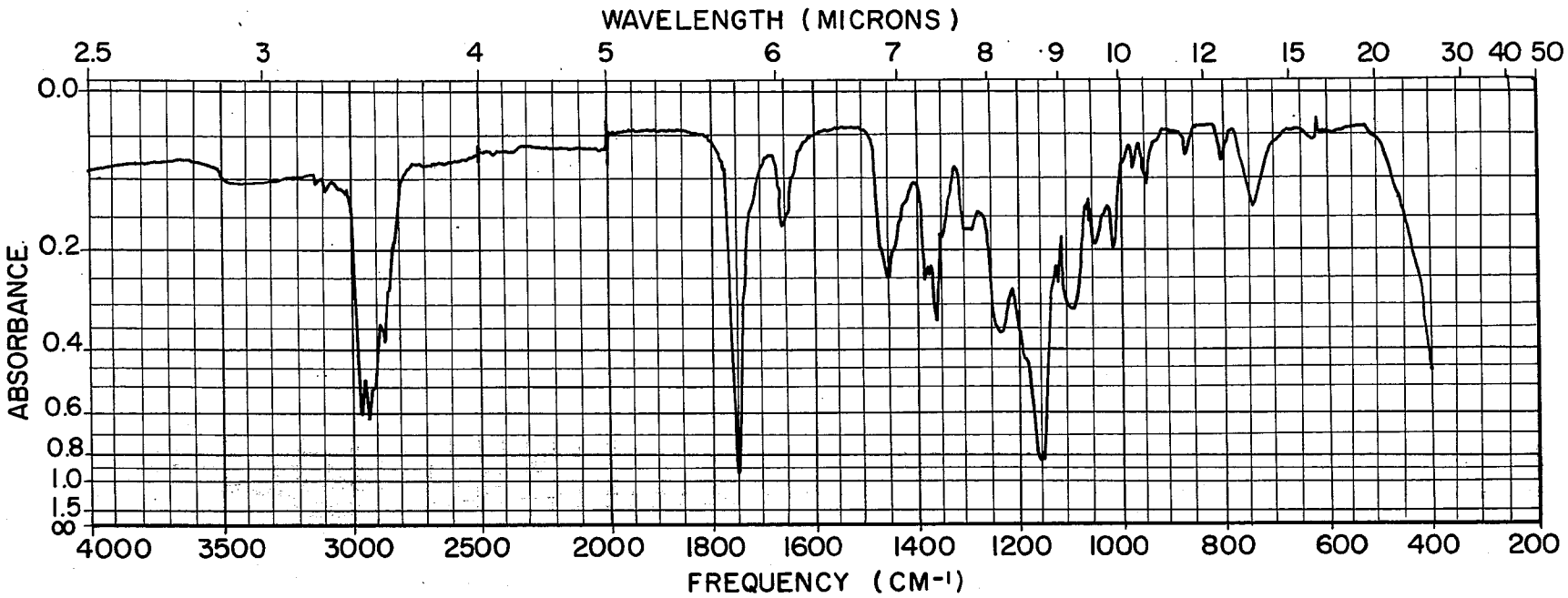
FIG. 4 is the IR spectrum for the cis isomer of beta-cyclohomocitral enol butyrate produced according to Example XXXIV.

The Infrared spectrum for the cis isomer of beta-cyclohomocitral enol butyrate is set forth in FIG. 4.

The Infrared analysis for the trans isomer of beta-cyclohomocitral enol butyrate is as follows:

930, 1100, 1160, 1360, 1750, 2870, 2940, 2960 $cm^{-1}$

Figure 5:
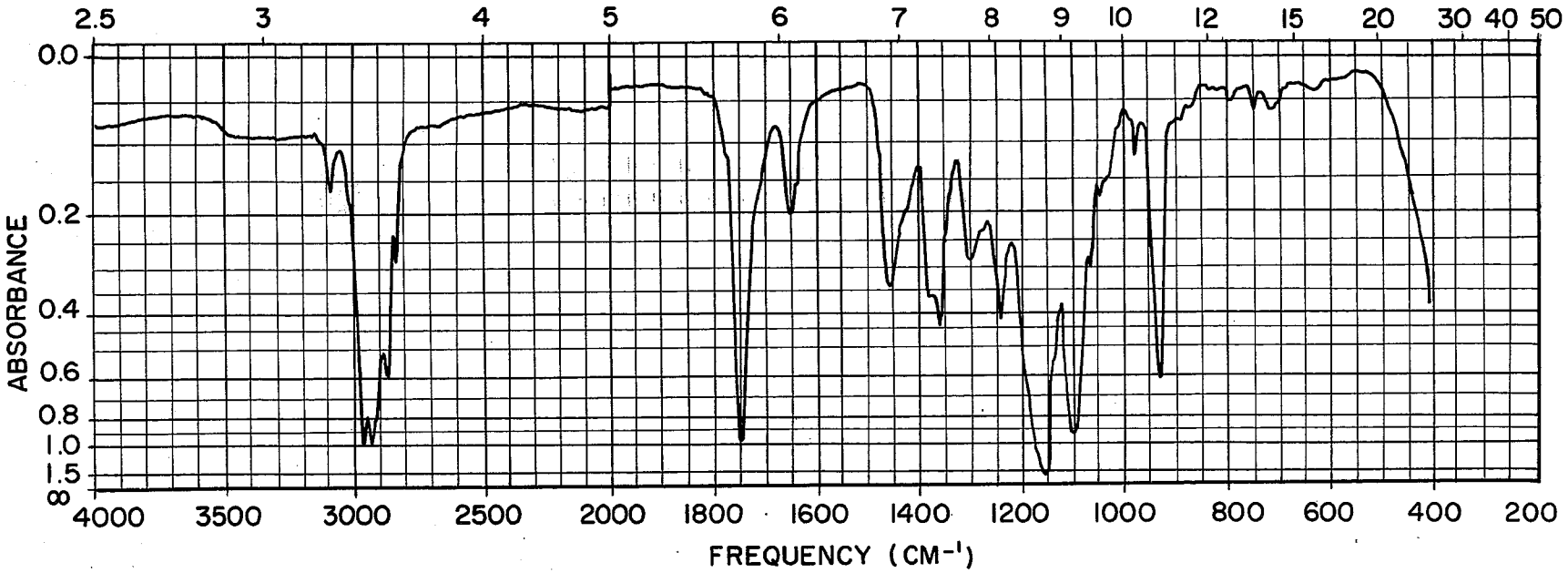
FIG. 5 is the IR spectrum for the trans isomer of beta-cyclohomocitral enol butyrate produced according to Example XXXIV.

The Infrared analysis for the trans isomer of beta-cyclohomocitral enol butyrate is set forth in FIG. 5.

The NMR spectrum for the trans isomer of beta-cyclohomocitral enol butyrate is set forth as follows:

| | | | |
|---|---|---|---|
| 1.00 ppm | doublet superimposed on triplet | $CH_3$ \ C — / $CH_3$ + $CH_3-CH_2-$ | 9H |

-continued

| | | | |
|---|---|---|---|
| 1.82–1.43 | multiplet | $=C-CH_3-$ + $-(CH_2)_3-$ | 11H |
| 2.00 | diffuse triplet | $=C-CH_2-$ | 2H |
| 2.40 | triplet | $-CH_2-C(=O)-O-$ | 2H |
| 5.86 7.02 | doublets (J=13 Hz, trans) | $HC(H)=C-O-C(=O)-$ | 2H |

Figure 6:
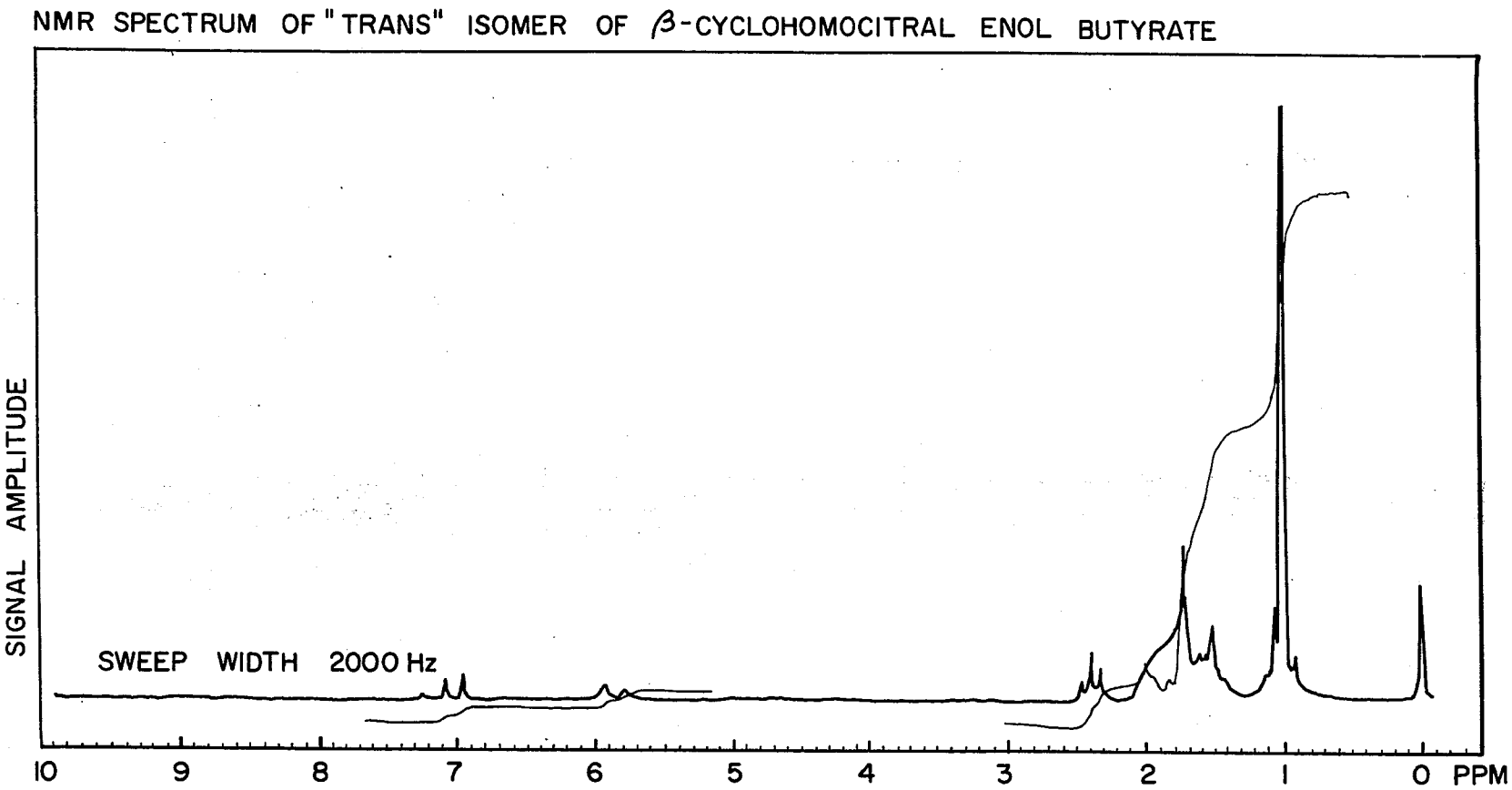
FIG. 6 is the NMR spectrum for the trans isomer of beta-cyclohomocitral enol butyrate produced according to Example XXXIV.

The NMR spectrum for the trans isomer of beta-cyclohomocitral enol butyrate is set forth in FIG. 6.

The crude reaction mass produced as described supra is admixed with 100 ml diethyl ether. The resulting diethyl ether solution is washed with two 100 ml portions of water and one 25 ml portion of saturated sodium bicarbonate. The washed ether solution is dried over anhydrous magnesium sulfate, filtered and stripped on a Rotovap evaporator yielding 32.4 g of product containing a significant amount of enol butyrate.

The trans beta-cyclohomocitral enol butyrate at 2 ppm has a sweet, rosey, fruity aroma. At 5 ppm it has a sweet/rosey, rosebud, rosey/fruity aroma and a rosey/fruity taste. At 20 ppm it has a sweet/rosey/fruity aroma and taste with a delicate "damascenone"-like character.

The cis beta-cyclohomocitral enol butyrate at 0.2 ppm only has a bitter aftertaste. At 2 ppm it has a weak rosey aroma. At 6 ppm it has a weak, rosey aroma and bitter aftertaste.

EXAMPLE XXXV

Production of Beta-Cyclohomocitral Enol Butyrate

Reaction:

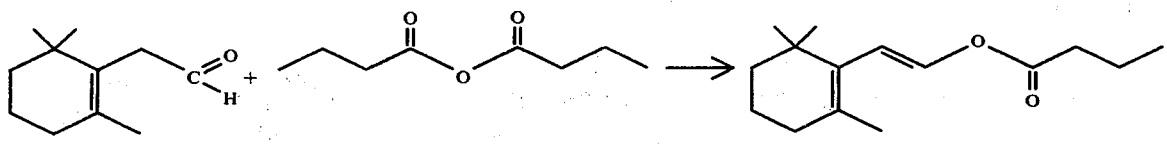

Into a 100 ml reaction flask are charged the following materials:

| | |
|---|---|
| beta-cyclohomocitral | 16.6 g (0.1 mole) |
| paratoluene sulfonic acid | 0.5 g (0.03 moles) |
| butyric anhydride | 39.5 g (0.25 mole) |

The reaction mass is heated with stirring to 170° C and maintained at 170° C for a period of 9.5 hours. At the end of this time GLC analysis indicates a substantial proportion of beta-cyclohomocitral enol butyrate (conditions: 4 feet × ¼ inch Carbowax 20 M column, programmed from 80°–180° C at 4° C per minute).

Figure 7:
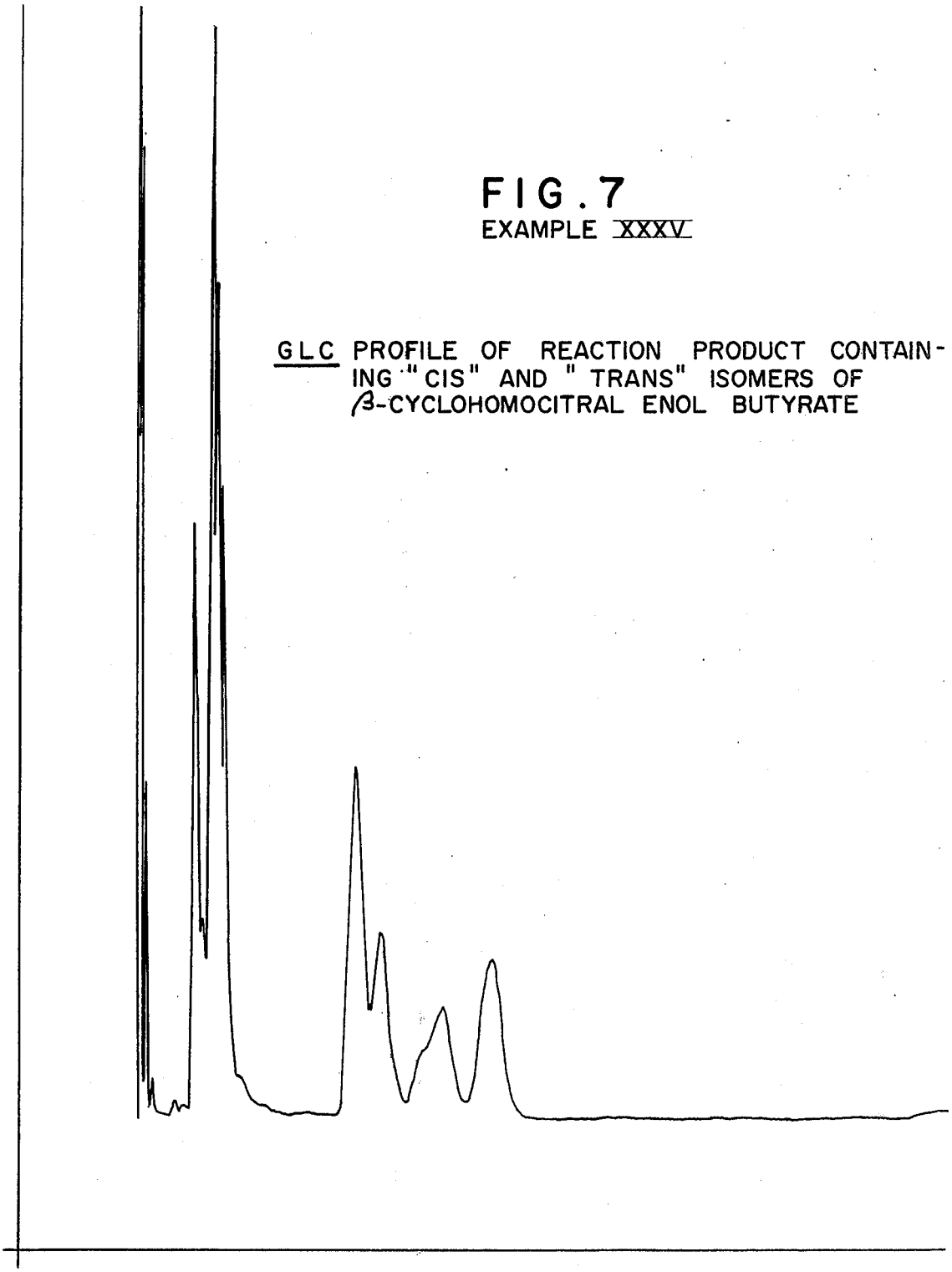
FIG. 7 is the GLC profile for the reaction product containing beta-cyclohomocitral enol butyrate produced according to Example XXXV.

The GLC profile is set forth in FIG. 7.

The GLC profile indicates a substantial amount of cis isomer and a substantial amount of trans isomer. NMR and mass spectral analyses confirm that peak "D" of FIG. 7 is the cis isomer and peak "E" is the trans isomer.

The crude material is admixed with 100 ml of ether and the resulting ether solution is washed with two 100 ml portions of water followed by one 25 ml portion of sodium bicarbonate. The washed ether solution is then dried over anhydrous magnesium sulfate, filtered and stripped using a "Rotovap" evaporator. The resulting product is 32.4 g product containing a significant proportion of beta-cyclohomocitral enol butyrate.

EXAMPLE XXXVI

Production of Beta-Cyclohomocitral Enol Butyrate

Reaction:

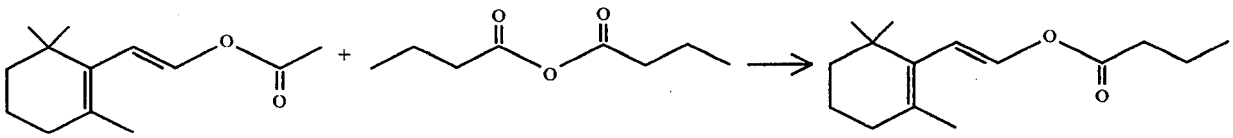

Into a 25 ml reaction flask the following materials are added:

| | |
|---|---|
| beta-cyclohomocitral enol acetate produced according to Example I | 2.0 g (0.008 moles) |
| butyric anhydride | 2.5 g (0.016 moles) |
| paratoluene sulfonic acid | trace |

The reaction mass is heated with stirring at a temperature of 170° C and maintained at that temperature for a period of 8 hours. At the end of this 8 hour period, GLC analysis indicates the presence of a substantial quantity of trans beta-cyclohomocitral enol butyrate. This is confirmed by NMR and mass spectral analyses.

Figure 8:
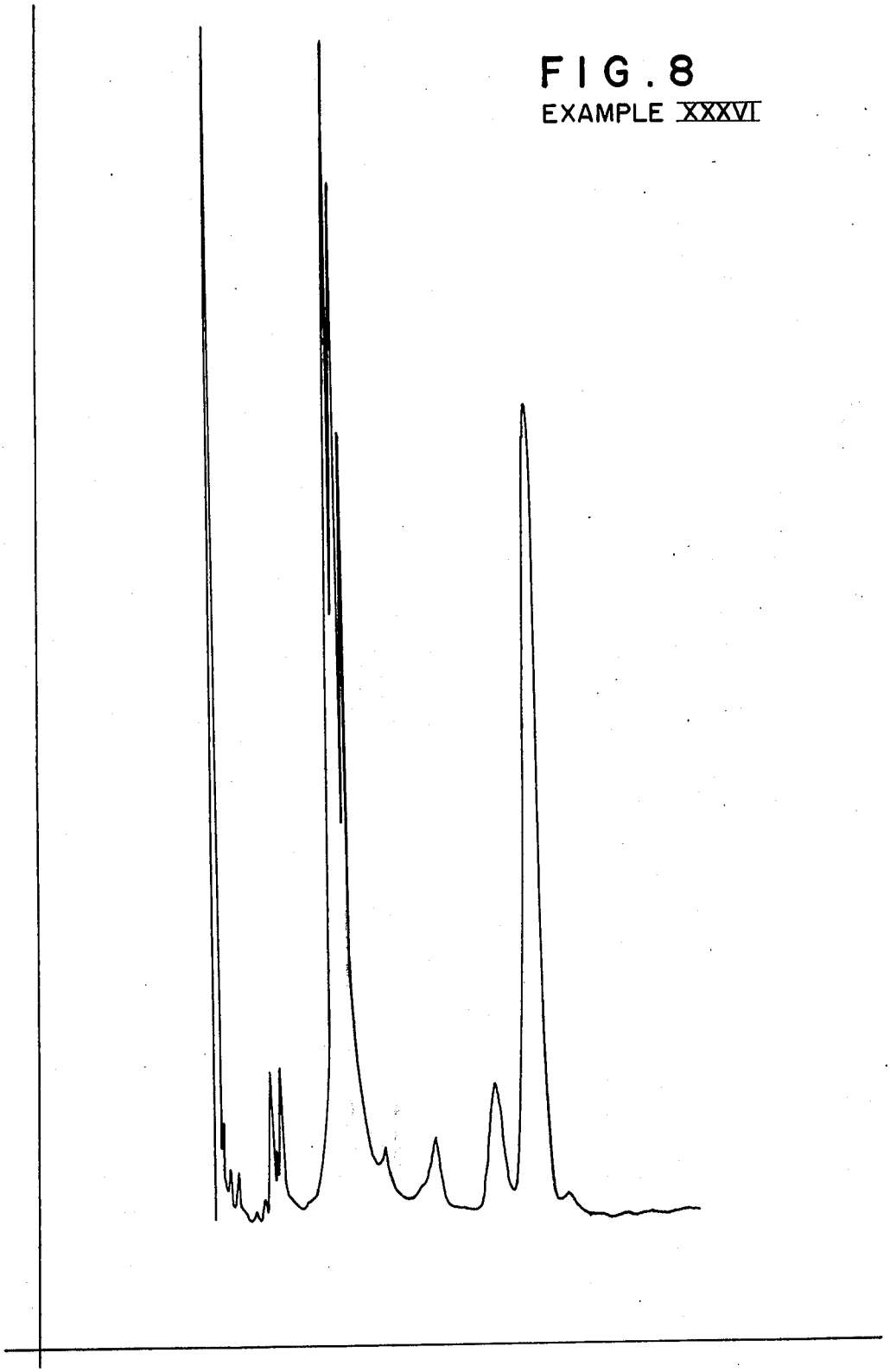
FIG. 8 is the GLC profile for the beta-cyclohomocitral enol butyrate produced according to Example XXXVI.

The GLC profile for the reaction product at the point in time is set forth in FIG. 8.

Figure 9:
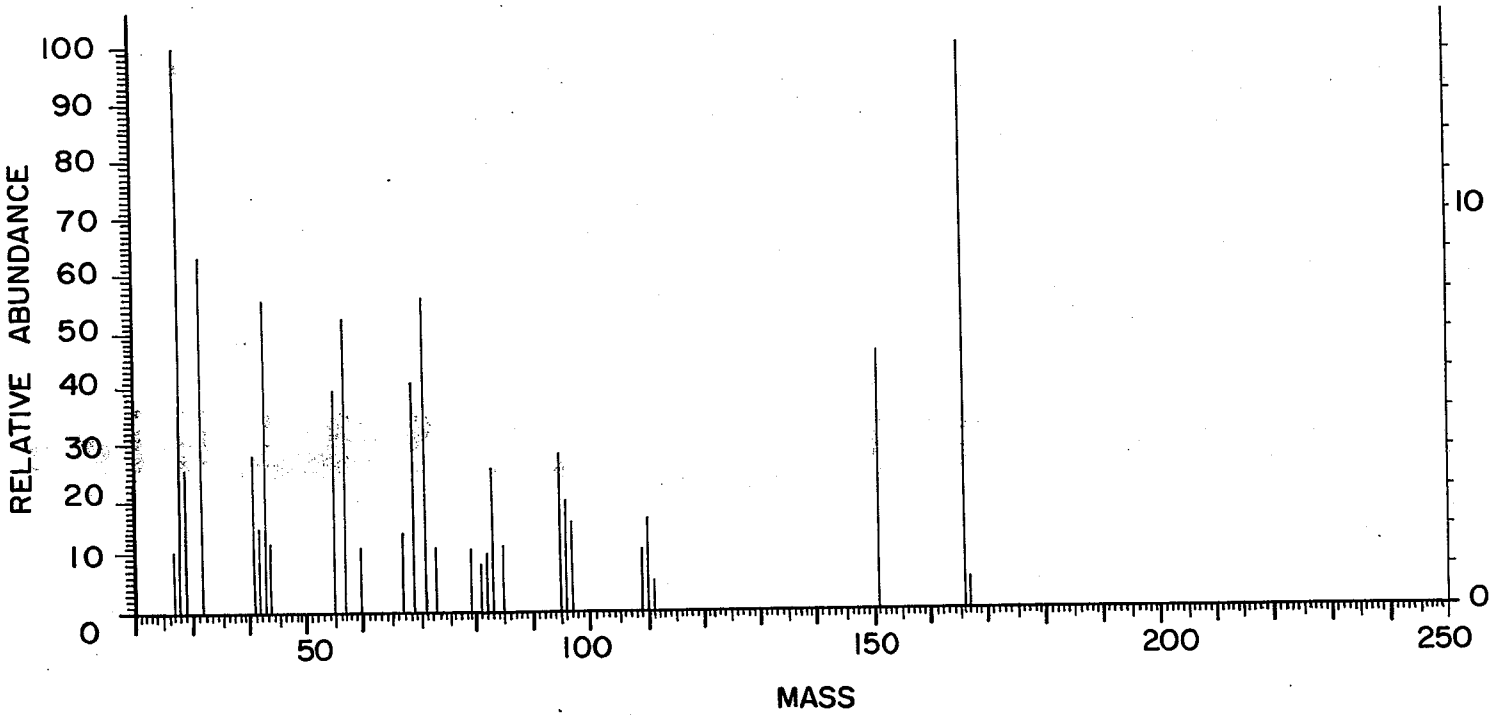
FIG. 9 is the GC-MS profile for beta-cyclohomocitral enol butyrate produced according to Example XXXVI.

The GC-MS profile is set forth in FIG. 9.

25 ml diethyl ether is admixed with crude product and the ether solution is washed with two 25 ml portions of water and one 25 ml portion of sodium bicarbonate. The washed ether solution is then dried over anhydrous magnesium sulfate, filtered and stripped on a Rotovap evaporator thus yielding a product containing a significant proportion of trans beta-cyclohomocitral enol butyrate.

What is claimed is:

1. A fragrance modifying composition comprising one or more 2,6,6-trimethyl-1-cyclohexen-1-ylacetaldehyde enol esters, having the structure:

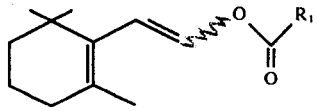

wherein $R_1$ is $C_1$14 $C_5$ lower alkyl; and an auxiliary perfume ingredient compatible with each of said 2,6,6-trimethyl-1-cyclohexen-1-ylacetaldehyde enol ester or esters.

2. A perfume composition comprising one or more 2,6,6-trimethyl-1-cyclohexen-1-ylacetaldehyde enol esters, as defined in claim 1, having the structure:

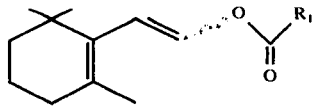

wherein $R_1$ is $C_1$–$C_5$ lower alkyl and at least one adjuvant selected from the group consisting of natural perfume oil, synthetic perfume oil, alcohols, aldehydes, ketones, esters and lactones.

3. A process for producing a perfumed composition comprising the step of admixing a composition of matter with a fragrance imparting amount of one or more 2,6,6-trimethyl-1-cyclohexen-1-ylacetaldehyde enol esters, as defined in claim 1, having the structure:

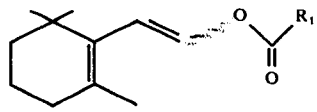

wherein $R_1$ is $C_1$–$C_5$ lower alkyl.

4. A cologne composition comprising ethanol, water and one or more 2,6,6-trimethyl-1-cyclohexen-1-ylacetaldehyde enol esters, as defined in claim 1, having the structure:

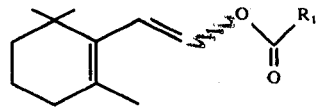

wherein $R_1$ is $C_1$–$C_5$ lower alkyl.

* * * * *